US006786704B2

(12) United States Patent
Kamiya et al.

(10) Patent No.: US 6,786,704 B2
(45) Date of Patent: Sep. 7, 2004

(54) COMPRESSOR WITH SINGLE SHAFT SUPPORT

(75) Inventors: Hirokazu Kamiya, Takahama (JP); Shigeru Kamiya, Nukata-gun (JP); Masafumi Inoue, Tajimi (JP); Takashi Inoue, Nishio (JP); Mikio Matsuda, Nishio (JP)

(73) Assignees: Denso Corporation, Kariya (JP); Nippon Sokin, Inc., Nishio (JP)

( * ) Notice: Subject to any disclaimer, the term of this patent is extended or adjusted under 35 U.S.C. 154(b) by 0 days.

(21) Appl. No.: 10/283,217

(22) Filed: Oct. 30, 2002

(65) Prior Publication Data

US 2003/0086792 A1 May 8, 2003

(30) Foreign Application Priority Data

| | | |
|---|---|---|
| Nov. 2, 2001 | (JP) | 2001-337916 |
| Feb. 4, 2002 | (JP) | 2002-027363 |
| Feb. 15, 2002 | (JP) | 2002-038491 |
| Feb. 21, 2002 | (JP) | 2002-044868 |

(51) Int. Cl.[7] ..... F04B 1/26; F04B 1/12; F01B 3/00

(52) U.S. Cl. ..... 417/222.2; 417/222.1; 417/269; 92/71

(58) Field of Search ..... 92/71; 91/499; 74/60; 417/269, 222.1, 222.2

(56) References Cited

U.S. PATENT DOCUMENTS

| | | | | | |
|---|---|---|---|---|---|
| 3,455,585 | A | * | 7/1969 | Raymond | 403/122 |
| 5,603,609 | A | * | 2/1997 | Kadlicko | 417/63 |
| 5,681,149 | A | * | 10/1997 | Weatherly | 417/269 |
| 5,836,749 | A | * | 11/1998 | Novacek et al. | 417/269 |
| 5,868,061 | A | * | 2/1999 | Hansen et al. | 92/71 |
| 5,947,003 | A | * | 9/1999 | Jepsen et al. | 92/248 |
| 6,024,011 | A | * | 2/2000 | Bergmann | 92/71 |

FOREIGN PATENT DOCUMENTS

| | | | | |
|---|---|---|---|---|
| EP | 1 113 171 A2 | * | 7/2001 | F04B/27/08 |
| JP | A-07-019164 | | 1/1995 | |
| JP | 09-303253 | * | 11/1997 | F04B/1/22 |
| JP | A-2000-018172 | | 1/2000 | |
| JP | A-2001-123945 | | 5/2001 | |
| JP | A-2001-234857 | | 8/2001 | |

* cited by examiner

*Primary Examiner*—Justine R. Yu
*Assistant Examiner*—Timothy P. Solak
(74) *Attorney, Agent, or Firm*—Posz & Bethards, PLC

(57) ABSTRACT

A piston type compressor having a drive plate (swash plate), wherein sliding friction between the drive plate and shoes is reduced and the compressor is made smaller by slidably attaching the shoes engaged with spherical ends of pistons to a shoe holding plate formed with guide grooves in the radial direction and supporting the shoe holding plate by the drive plate through a thrust bearing. The drive plate is connected to an arm of the shaft side through a double slide link mechanism to enable it to be supported by only a front end of the front housing.

22 Claims, 30 Drawing Sheets

COMPRESSOR WITH SINGLE SHAFT SUPPORT

BACKGROUND OF THE INVENTION

1. Field of the Invention

The present invention relates to a compressor for a fluid such as a refrigerant compressor used in a refrigeration cycle of an air-conditioning system mounted in a vehicle.

2. Description of the Related Art

There are two leading types of conventional drive plate (or swash plate) type piston compressors. One type takes out reciprocating motion directly to a piston by bringing two semispherical shoes attached to the end of the piston into direct frictional contact with the front and rear surfaces of a drive plate attached to a shaft in a tilted state and engaging in rotary motion and rocking motion. The problem with a compressor of this type is that at the time of high speed rotation of the compressor, the relative sliding speed between the drive plate and the shoes becomes large, so under operating conditions where the supply of lubrication oil becomes insufficient, the lubrication state between the drive plate and shoes becomes poor and seizing or other trouble easily occurs. Further, since the drive plate and the shoes engage in frictional contact, there is also the problem of a large mechanical loss compared with rolling contact.

The other type changes the large frictional sliding contact between the drive plate and shoes to rolling contact to reduce the mechanical loss etc. One example is described in Japanese Unexamined Patent Publication (Kokai) No. 2001-123945.

In this type, one end of each piston has attached to it shoes able to freely tilt with respect to an axis of the piston. Further, a thrust needle bearing is interposed between the shoes and the drive plate so that the sliding contact parts become rolling contact parts. These constituent elements enable a compression operation pushing the piston into the cylinder bore to compress the fluid, but do not enable a suction operation of pulling the piston out from the cylinder bore to suck the fluid. The reason is that the thrust needle bearing can support a compressive load in the axial direction, but cannot transmit or support a tensile load.

Therefore, the compressor described in the above-mentioned Japanese Unexamined Patent Publication (Kokai) No. 2001-123945 is configured to enable a suction operation by providing a rocking member engaging with and holding the shoes attached to the end of a piston with a suitable clearance and a slider slidably engaging with the shaft in the axial direction, by connecting the rocking member and slider by a roller bearing, and by biasing the slider toward the drive plate by a coil spring. The compressor of this example is a fixed capacity type, but even if making the tilt angle of the drive plate variable to try to remodel the compressor to a variable capacity type, with this configuration, it is impossible to change the tilt angle of the rocking member engaged with and holding the shoes, so this compressor cannot be made a variable capacity type.

Further, in this example, in the same way as the structure in general use in a conventional compressor of this type, the shaft passes through the center of the drive plate and the rocking member (shoe holding plate) driven by this through a bearing and extends to the inside of the cylinder block, so a bearing is provided inside the cylinder block to support the front end of the shaft. In this case, while there is nothing which has to be driven by the shaft other than the drive plate, since the shaft passes through the rocking member etc. and extends to the cylinder block at the rear, there is the problem that the compressor as a whole becomes larger than necessary.

Further examples of the conventional compressor are shown in Japanese Unexamined Patent Publication (Kokai) No. 7-19164 and Japanese Unexamined Patent Publication (Kokai) No. 2001-234857. One structure is illustrated in FIG. 38. These compressors fall under the category of drive plate type (or swash plate type) piston type variable capacity compressors. The housing forming the shell is comprised of three parts—front housing 1, a cylinder block 2, and a rear housing 3—joined by means such as not shown through bolts. Pistons 7 are inserted into the plurality of cylinder bores 21 formed in the center cylinder block 2 and are forced to engage in reciprocating motion by a common drive plate (swash plate) 5 through shoes 8. The drive plate 5 is driven to rotate by a long shaft 4 passing through its center and extending to the center of the cylinder block 2. The front end of the shaft 4 is axially supported by a bearing 64 provided in the cylinder block 2.

In the operating state, due to the rocking motion of the drive plate 5 rotating together with the shaft 4, the pistons 7 engage in reciprocating motion in their cylinder bores 21 to expand and compress working chambers 21*a* and thereby cause a fluid such as a refrigerant to pass through a suction valve 13 and be sucked into the working chambers 21*a* from a suction chamber 31 formed at the center of the rear housing 3 so as to be compressed, then pass through a discharge valve 11 and be discharged into a large volume discharge chamber 32 formed at the outer periphery of the rear housing 3. This compressor enables the tilt angle of the drive plate 5 to be smoothly changed, so enables the discharge capacity to be continuously changed.

In a compressor of the type causing pistons to engage in reciprocating motion to compress a fluid, both the suction operation from the suction chamber 31 to the working chambers 21*a* and the discharge operation of the fluid compressed in the working chambers 21*a* to the discharge chamber 32 are performed intermittently, so pressure fluctuations (pulsation) of the fluid occur in the suction chamber 21 and the discharge chamber 32. Due to this, sometimes vibration or a groaning-like noise occurs, so to suppress pressure fluctuations in the suction chamber 31 and discharge chamber 32 and smooth the flow of fluid into the compressor and the flow of fluid out of it, the conventional compressor has been designed to make the capacity of the suction chamber or discharge chamber as large as possible. Therefore, by common sense, enlargement of the drive plate type compressor as a whole by the amount of increase of capacity of the suction chamber and discharge chamber as a measure for preventing vibration and noise is an unavoidable problem.

Still another example of a conventional compressor is described in Japanese Unexamined Patent Publication (Kokai) No. 2000-18172. The structure of this compressor as a whole is shown in FIG. 44, which part of it, that is, the part of the capacity control valve, is shown in FIG. 45. This compressor falls under the category of a drive plate type variable capacity compressor. The housing forming the shell is comprised of three parts—a front housing 1, a cylinder block 2, and a rear housing 3—joined by through bolts 40. Pistons 7 are inserted into a plurality of cylinder bores 21 formed in the center cylinder block 2 and are forced to engage in reciprocating motion by a common drive plate 5 through shoes 8. The drive plate 8 is driven to rotate by a long shaft passing through its center and extending to the center of the cylinder block 2. The front end of the shaft 4 is axially supported by a bearing 64 provided in the cylinder block 2.

In the operating state, due to the rocking motion of the drive plate 5 rotating together with the shaft 4, the plurality of pistons 7 engage in reciprocating motion in their cylinder bores 21 to expand and compress working chambers 21*a* and thereby cause a fluid such as a refrigerant to pass through a suction valve and be sucked into the working chambers formed at the top faces of the pistons in the cylinder bores 21 from a suction chamber 31 formed at the outer periphery of the rear housing 3 so as to be compressed, then pass through a discharge valve and be discharged into a discharge chamber 32 formed at the center of the rear housing 3. This compressor enables the tilt angle of the drive plate 5 to be smoothly changed, so enables the discharge capacity to be continuously changed.

In a compressor as shown in FIG. 44, it is possible to change the tilt angle of the drive plate 5 so as to simultaneously change the strokes of all of the pistons 7 and control the discharge capacity of the compressor as a whole to smoothly change. This control involves operating a capacity control valve 33 attached to the rear housing 3 to change the back pressure of all of the pistons 7, that is, the pressure in a drive plate chamber 1*a* formed in the front housing 1. Since the capacity control valve 33 is provided so as to stick out in the axial direction from the rear housing 3, the conventional compressor had the problem that the provision of the capacity control valve 33 remarkably increased the length of the compressor in the axial direction.

There are reasons why the capacity control valve 33 was generally placed at that position in a conventional compressor despite the existence of such a problem. The first reason is that even if trying to provide the capacity control valve 33 inside the compressor, there is just not enough space for holding the capacity control valve 33 inside the compressor. The second reason is that the capacity control valve 33 receives both of a low pressure fluid in the suction chamber 31 and a high pressure fluid in the discharge chamber 32 to create a pressure of any level between the high pressure and low pressure and supplies the same to the drive plate chamber 1*a*, so if attaching the capacity control valve 33 to the rear housing 3 formed with the suction chamber 31 and the discharge chamber 32, the flow path connecting them becomes shorter and simpler in configuration. The third reason is that if the capacity control valve 33 is provided at the outer periphery of the cylinder block 2 rather than the rear housing 3, the housing of the compressor would stick out largely in the radial direction, the position of provision of the capacity control valve 33 and the compressor as a whole would become bulkier, and further the routing of the flow path would become more difficult.

Note that in the prior art shown in FIG. 44 and FIG. 45, a tube 36 is provided for guiding the motion of a plunger 35 inside a solenoid coil 34 of the capacity control valve 33. This tube 36 is not just a guide, but also a seal tube for preventing the high pressure fluid etc. in the discharge chamber 32 from passing through the inside of the capacity control valve 33 and leaking out to the atmosphere, so both a high air-tightness and pressure resistance are required as performance. Further, this tube 36 has to be one which allows magnetic flux to permeate efficiently for making the plunger 35 operate efficiently by the solenoid coil 34. It is however extremely difficult to meet all of these conditions. Therefore, for example, the problem arises that if stressing the sealability and thereby sacrificing the magnetic permeability, the magnetic efficiency falls or else the structure becomes complicated.

SUMMARY OF THE INVENTION

The present invention was made in consideration of the above-mentioned problems in the prior art and has as its object to provide a compressor of a novel configuration enabling these problems to be solved.

The present invention further has as its object to deal with the vital problems of a drive plate type compressor and provide a much smaller drive plate type compressor than a conventional compressor having the same degree of discharge capacity by making the capacities of the suction chamber and discharge chamber as large as possible to thereby sufficiently suppress pressure fluctuations in the fluid and introducing a new means not increasing the size of the compressor as a whole while preventing vibration and noise.

The present invention further has as its object to provide a much smaller drive plate type compressor than a conventional compressor having the same degree of discharge capacity by introducing a new means not requiring an increase of the size of the compressor as a whole when providing a capacity control valve in a compressor such as a drive plate type variable capacity compressor.

The present invention, as a first means for solving the above problems, provides a compressor comprising a shaft axially supported by only a front end of a housing through a bearing and receiving rotational power from a power source; a drive plate rotating by being connected with and supported by the shaft and able to tilt with respect to the shaft; a shoe holding plate supported by the drive plate through a holding plate thrust bearing forming a roller bearing and thereby taking the same tilt angle, but prevented from rotating; a plurality of shoes able to engage with a plurality of shoe guide grooves formed in a radial direction at a peripheral part of the shoe holding plate and slide in the radial direction; a drive thrust bearing arranged between the shoes and the drive plate; a plurality of pistons directly connected with the shoes and engaging in reciprocating motion, inserted in cylinder bores to suck in and compress a fluid, and preventing rotation of the shoe holding plate; and means for changing the tilt angle of the drive plate and the shoe holding plate to change a discharge capacity.

In this compressor, the shoes connected to the pistons support the load required for the compression operation through the drive thrust bearing arranged between the shoes and the drive plate, so there is no sliding and frictional sliding at a high speed while supporting the load as in the shoes of a conventional drive plate type compressor and therefore there is no longer any liability of seizing due to friction of sliding parts, increased mechanical loss, etc.

Further, the shoes are biased to the drive thrust bearing side by the shoe holding plate formed with the plurality of shoe guide grooves in the radial direction to prevent occurrence of clearance between the drive plate and drive thrust bearing and the shoes. This shoe holding plate is rotatably supported relatively on the axis of rotation of the drive plate, so even when changing the tilt angle of the drive plate to change the discharge capacity of the compressor, it completely follows the tilt of the drive plate to take the same tilt angle. Therefore, the clearance between the shoes and drive plate is constantly held the same and there is no trouble of the clearance between the two increasing when changing the discharge capacity.

In the compressor of the present invention, each shoe may be comprised of a shoe body provided with a spherical depression engaging with a spherical end provided at a piston and a shoe flange sticking out to the sides integrally from the shoe body. In this case, since the shoe engaged with the piston engages with a shoe guide groove formed in the radial direction in the shoe holding plate by the shoe body and the shoe flange provided there, the shoe is reliably biased to the drive plate side. Note that the area of the contact part between a shoe and the shoe holding plate desirably is made larger from the viewpoint of reducing the planar load.

In the past, this type of shoe was generally mostly disk shaped, but if the diameter of the shoe is increased to increase the contact area as explained above, the shoe sticks out from the periphery of the drive plate. Therefore, the drive plate becomes larger in diameter. As a result, the girth of the compressor becomes larger and, at the center side, the problem arises of the shoe interfering with the center of the shoe holding plate. As opposed to this, in the case of the compressor of the present invention, since the shoe can be made a substantially rectangular shape, it is smaller than a disk shaped shoe and there is no liability of it sticking out from the periphery of the drive plate or interfering at the center. Despite this, it can reliably engage with the shoe holding plate and increase the contact area with the shoe holding plate.

The present invention further provides a compressor comprised of a shaft receiving rotational force from a power source; a drive plate rotating by being connected with and supported by the shaft and able to tilt with respect to the shaft; a shoe holding plate supported by the drive plate through a holding plate thrust bearing forming a roller bearing and thereby taking the same tilt angle; a plurality of pistons inserted in cylinder bores to suck in and compress a fluid and preventing rotation of the shoe holding plate; and a mechanism for converting tilted rotary motion of the drive plate to reciprocating motion of the pistons, wherein, as a means for changing the tilt angle of the drive plate to change a discharge capacity, a slide link mechanism comprised of a plurality of pins and a plurality of guide grooves with which the pins engage is provided at a position away from the axial center of the shaft for connecting the shaft and the drive plate.

In this compressor, the drive plate and shoe holding plate can of course smoothly change in tilt angle with respect to an imaginary plane perpendicular to the shaft while maintaining suitable postures and positions. Due to this mechanism, there is no longer a need for the shaft to pass through the drive plate and the center of a member like the shoe holding plate included in the mechanism for converting the tilted rotary motion of the drive plate to reciprocating motion of the pistons, so it is possible to reduce the size of the bearing means such as the holding plate thrust bearing naturally becoming necessary to rotatably connect the member like the shoe holding plate to the drive plate. Therefore, it is possible to reduce the size of the compressor as a whole.

In the compressor of the present invention, the shaft may be axially supported by only a front end of the compressor housing. In this case, there is no need at all for the shaft to pass through the drive plate, shoe holding plate, or other such members, so the compressor can be made smaller as a whole.

In the compressor of the present invention, it is possible to configure each piston from a conical shoulder part formed integrally with a spherical end in advance, a cylindrical part joined with the conical shoulder part, and a bottom part joined with the cylindrical part; configure it from a conical shoulder part formed integrally with a spherical end in advance, a cylindrical part formed integrally with the conical shoulder part in advance, and a bottom part joined with the cylindrical part; configure it from a conical shoulder part formed integrally with a spherical end in advance, a cylindrical part joined with the conical shoulder part, and a bottom part formed integrally with the cylindrical part in advance; configure it from a conical shoulder part joined with a spherical end, a cylindrical part joined with the conical shoulder part, and a bottom part joined with the cylindrical part; and configure it from a conical shoulder part joined with a spherical end, a cylindrical part formed integrally with the conical shoulder part in advance, and a bottom part formed integrally with the cylindrical part in advance. Due to this, a tough piston with no parts of stress concentration is obtained.

In the compressor of the present invention, the parts forming each piston may be strongly joined by welding or calking. Further, the piston may be made a hollow structure. Due to this, the piston is lightened, so the amount of power required for driving the piston becomes comparatively smaller than when preventing unreasonable force from acting on the mechanism supporting or driving the piston.

The piston may be fabricated from a ferrous material. Due to this, the strength and durability are greatly improved over the aluminum piston frequently used in the past. If made a hollow structure, the increase in weight also does not become a problem.

Further, it is possible to provide a torsion coil spring biasing the drive plate in a direction reducing the tilt angle in a state where the tilt angle of at least the drive plate is large and in a direction increasing the tilt angle in an operating state where the tilt angle is zero or minimal. By providing this torsion coil spring, when the tilt angle of the drive plate is zero or minimal, the torsion coil spring biases the drive plate to increase its tilt angle, so if there is no force acting against this, the tilt angle of the drive plate will increase and therefore quick response will be possible when the need next arises to increase the discharge capacity.

The torsion coil spring may be made a single continuous spring. Due to this, the biasing means for increasing the tilt angle of the drive plate becomes simpler in configuration and the number of parts is reduced compared with the case of using two coil springs as in the past.

In the compressor of the present invention, each shoe may be comprised of a shoe body and a shoe flange, and the shoe body may be formed by casting so as to surround a spherical end at the piston side. Further, the piston may be formed by casting so as to surround a spherical end of a connecting rod side where the piston is connected with a shoe. Therefore, in both cases, since the shape of the spherical end is transferred to the shoe surrounding it or the spherical depression of the piston side by casting, there is no need for mechanically processing the spherical depression and an equivalent surface precision can be automatically obtained. Further, since there is no calking performed, the thickness of the member forming the depression can be increased and strengthened at will.

In the compressor of the present invention, as the drive thrust bearing, one comprised of a large number of short rollers arranged radially divided into groups on a plurality of concentric circles can be used. In this case, since the rollers are short, the difference in peripheral speeds at the two ends becomes smaller and the slip ratio is reduced. Since a large number of rollers are arranged on concentric circles to bear the load, it is possible to support a large load equivalent to the case of using long rollers with a large slip ratio. Therefore, the wear of the drive thrust bearing is reduced and the power loss also falls.

More specifically, a large number of short rollers arranged radially divided into groups on a plurality of concentric circles may be held by a separate holder for each group of rollers on each concentric circle. Further, a large number of short rollers arranged radially divided into groups on a plurality of concentric circles may be held by a common holder. Further, a plurality of rollers arranged in a radial direction on the same line among a large number of short rollers arranged radially divided into groups on a plurality of concentric circles may be held by a same window opening formed in a common holder.

In the compressor of the present invention, as the shoe held by the shoe holding plate, one provided with a shoe flange integral with a shoe body may be used. The planar shape of the shoe flange may be made a substantially rectangular shape. Alternatively, the planar shape of the shoe flange may be made a substantially fan shape. Further alternatively, the planar shape of the shoe flange may be made substantially a shape intermediate between a rectangular shape and fan shape. In any case, compared with the case of a planar large circular shape of the shoe flange, the flange can be made as large as possible while avoiding mutual interference, so the sliding action of the shoes becomes smoother and therefore the discharge capacity can be changed smoothly.

In the compressor of the present invention, it is possible to remove the shoe holding plate and drive thrust bearing and have the shoes directly slidingly engage with the drive plate. In this case, the engaging parts of the drive plate and shoes are configured as often used in the past, but the shaft does not pass through the drive plate, and the drive plate is supported by only the front end of the housing. Therefore, even with this configuration, the effects of the present invention explained above can be obtained.

The present invention, as another means for solving the above problems, provides a compressor comprising a shaft receiving rotational power from a power source; a plurality of pistons engaging in reciprocating motion by being driven connected to the shaft; a cylinder block formed with a plurality of cylinder bores receiving the pistons; a suction chamber from which the pistons cause fluid to be sucked into working chambers formed in the cylinder bores; a discharge chamber to which fluid compressed in the working chambers is discharged; at least one muffler chamber forming an open space formed using a dead space of the cylinder block; and a communication port for communicating the muffler chamber and at least one of the suction chamber and discharge chamber.

In this compressor, since provision is made of a communication port for communicating at least one muffler chamber forming an open space formed using the dead space of the cylinder block with at least one of the suction chamber and discharge chamber, the suction chamber or discharge chamber communicated with the muffler chamber becomes substantially the same in state as if increased in capacity. As a result, suction or discharge pulsation is suppressed by the large capacity of the suction chamber or discharge chamber. Since however the muffler chamber is formed using the dead space of the cylinder block, the size of the compressor does not become larger due to the provision of the muffler chamber. By providing the drive plate at the shaft, it is possible to form a drive plate type compressor making the pistons engage in reciprocating motion through the drive plate. Similar effects are obtained in this case as well.

When the drive plate is connected to the shaft so as to be able to be changed in tilt angle, the compressor operates as a drive plate type variable capacity compressor. Therefore, not only are similar effects to the above case obtained, but also the discharge capacity can be smoothly changed. Further, it is possible to support the shoe holding plate taking the same tilt angle as the drive plate, but prevented from rotation, by the drive plate through the drive thrust bearing and possible to guide the plurality of shoes engaged with the ends of the pistons so as to be able to freely slide in the radial direction by the plurality of shoe guide grooves formed in the radial direction at the periphery of the shoe holding plate. Due to this, the shoes do not directly frictionally engage with the drive plate, so an efficient compressor is obtained. Further, if configuring each shoe by a shoe body provided with a spherical depression engaging with the spherical end provided at a piston and a pair of shoe flanges sticking out to the two sides integrally from the shoe body and engaging with the shoe holding plate, the shoe is smoothly guided by the shoe holding plate. In both cases, similar effects to the above case are obtained.

In this compressor, as the means for changing the tilt angle of the drive plate to change a discharge capacity and for connecting the shaft and the drive plate, it is possible to provide a slide link mechanism comprised of a plurality of pins and a plurality of guide grooves with which the pins engage at a position away from the axial center of the shaft. In this case as well, it is possible to axially support the shaft by just the front end of the housing. In both cases, the shaft does not pass through the drive plate and extend to the cylinder block, so a dead space occurs at the cylinder block. Therefore, it is possible to form a muffler chamber of a large capacity using this dead space, so it becomes possible to effectively reduce the suction or discharge pulsation.

The present invention, as still another means for solving the above problems, provides a compressor comprising a plurality of pistons for compressing a fluid; a cylinder block formed with a plurality of cylinder bores for receiving the pistons; and a capacity control valve for changing a discharge capacity of the compressor attached using a dead space of the cylinder block where the cylinder bores are not formed.

In this compressor, since a capacity control valve for changing the discharge capacity of the compressor is provided using some sort of dead space formed in the cylinder block, the size of the compressor will not become larger due to the provision of the capacity control valve. Since the capacity control valve is provided inside the compressor, if designing the capacity control valve to be immersed in the fluid to be compressed, the only part which need be made hermetic against the outside in the capacity control valve is the place where the signal line is led out. Therefore, sealing the capacity control valve becomes easier than in a conventional compressor.

Specifically, this compressor can be embodied comprising a shaft receiving rotational force from a power source; a drive plate rotating by being driven connected with the shaft and able to tilt with respect to the shaft; a plurality of pistons engaging in reciprocating motion by engaging with the drive plate; a cylinder block formed with a plurality of cylinder bores receiving the pistons in parallel with the shaft around a center axis of the shaft; and a capacity control valve attached using a dead space at a center of the cylinder block and able to change a tilt angle of the drive plate so as to change a discharge capacity of the compressor.

The present invention, as another means to solve the above problems, provides a drive plate type variable capacity compressor provided with a drive plate driven to rotate by being connected to a shaft, making a plurality of pistons engage in reciprocating motion through this drive plate, and able to smoothly change the discharge capacity by changing the tilt angle of the drive plate, wherein the plurality of cylinder bores receiving the plurality of pistons are formed parallel to the shaft in the cylinder block around the center axis of the shaft and wherein a capacity control valve for changing the tilt angle of the drive plate is provided using the dead space formed at the center of the cylinder block. In this case as well, effects similar to those of the above case are obtained.

It is possible to change the pressure in the drive plate chamber housing the drive plate by the above capacity control valve so as to change the discharge capacity of the compressor. The pressure of the drive plate chamber is the back pressure of all of the pistons, so if the pressure in the drive plate chamber is changed by the operation of the capacity control valve, the state of balance with the reaction force of the fluid compressed by the pistons in the working chambers in the cylinder bores will change, the average axial direction position of the pistons will change, and the tilt angle of the drive plate will change to change the strokes of the pistons, so the discharge capacity of the compressor will change smoothly.

Further, in this compressor, it is possible to support a shoe holding plate taking the same tilt angle as the drive plate, but prevented from rotating, by the drive plate through a drive thrust bearing and to guide the plurality of shoes engaging with ends of pistons so as to be able to slide freely in the radial direction by a plurality of shoe guide grooves formed in the radial direction at a peripheral part of the shoe holding plate. Due to this, the shoes do not directly engage frictionally with the drive plate, so an efficient drive plate type variable capacity compressor is obtained. In this case as well, similar effects to the above are obtained.

Further, in this compressor, as a means for changing the tilt angle of the drive plate to change a discharge capacity and for connecting the shaft and the drive plate, a slide link mechanism comprised of a plurality of pins and a plurality of guide grooves with which the pins engage may be provided at a position away from the axial center of the shaft. Further, the shaft may be axially supported by just a front end of the housing through a bearing. In both cases, since the shaft does not pass through the drive plate and extend to the cylinder block, a large dead space occurs in the cylinder block. Therefore, a capacity control valve can be provided using the dead space in the cylinder block, so the size of the compressor will not become greater.

Further, in this compressor, the capacity control valve can create any pressure between the pressure of the suction chamber and the pressure of the discharge chamber. Due to this, the discharge capacity of the compressor can be smoothly changed.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

Figure 1:
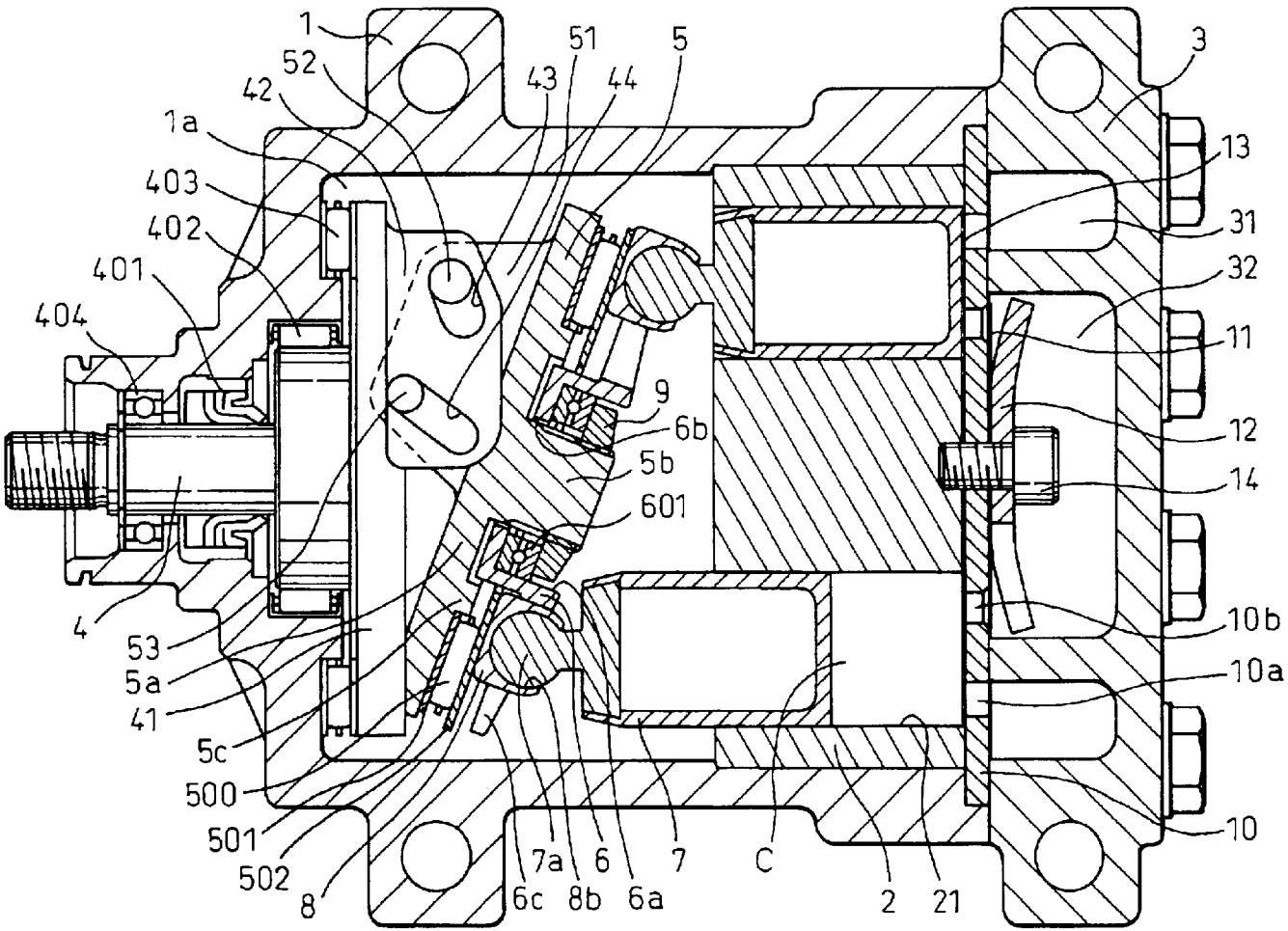
FIG. 1 is a longitudinal sectional front view of a first embodiment of a compressor of the present invention.

FIG. 1 to FIG. 4 show a first embodiment of a compressor of the present invention. In FIG. 1, which shows the longitudinal sectional structure of the compressor as a whole in an operating state giving the maximum discharge capacity, reference numeral 1 is a front housing constituting part of a shell of the compressor, while 2 is a cylinder block which is inserted into the front housing 1 and is joined with the front housing 1 and a rear housing 3 at the back by fastening means such as through bolts. At the inside of the cylinder block 2, a plurality of (for example, six) cylinder bores 21 are formed extending in the lateral direction in FIG. 1 (later mentioned "axial direction") generally equidistantly around a center axis. At the outer periphery at the inside of the rear housing is formed a suction chamber 31 forming an open space. At the center is formed a discharge chamber 32 forming an open space.

Reference numeral 4 is a shaft for receiving rotational power from an external power source. A disk part 41 is formed integrally perpendicular to the same. A single radial direction arm 42 is provided to stick out generally in the axial direction from part of the outer periphery of the disk part 41. At the arm 42 are formed two guide grooves serving as cams, that is, a top guide groove 43 and a bottom guide groove 44, in predetermined shapes at predetermined positions at the top and bottom. The shaft 4 is axially supported by the front housing 1 through radial bearings 402 and 404 and is axially supported by the front housing 1 in the axial direction as well through a thrust bearing 403 supporting the back surface of the disk part 41. Note that shaft sealing devices 401 are provided at these bearing parts to prevent fluid from leaking from around the shaft 4 to the outside.

Reference numeral 5 is a drive plate comprised of a generally disk shaped disk part 5*a*, a shaft part 5*b* formed so as to project from its center, a rim part 5*c* projecting in a ring shape from the disk part 5*a* around the shaft part 5*b*, etc. The drive plate 5 is provided with two radial direction arms 51 projecting from its back surface toward the disk part 41 and supports two pins 52 and 53 between the two arms 51. These pins 52 and 53 are inserted into the top guide groove 43 and bottom guide groove 44 formed in the above-mentioned arm 42 at the shaft 4 side to be slidably engaged with the same. Due to this, the drive plate 5 can rotate together with the shaft 4 and can tilt with respect to the shaft 4.

The shaft part 5*b* of the drive plate 5 has fit over it a shoe holding plate 6 having an opening at its center. This is rotatably connected with the drive plate 5 by a holding plate thrust bearing 601 and holding nut 9. The shoe holding plate 6 grips the later-explained shoes 8 and drive thrust bearing 500 with the drive plate 5 and is used to guide movement of the shoes 8 in the radial direction. Note that the shaft part 5*b* of the drive plate 5 is provided with a male thread for screwing into the holding nut 9.

Figure 2:
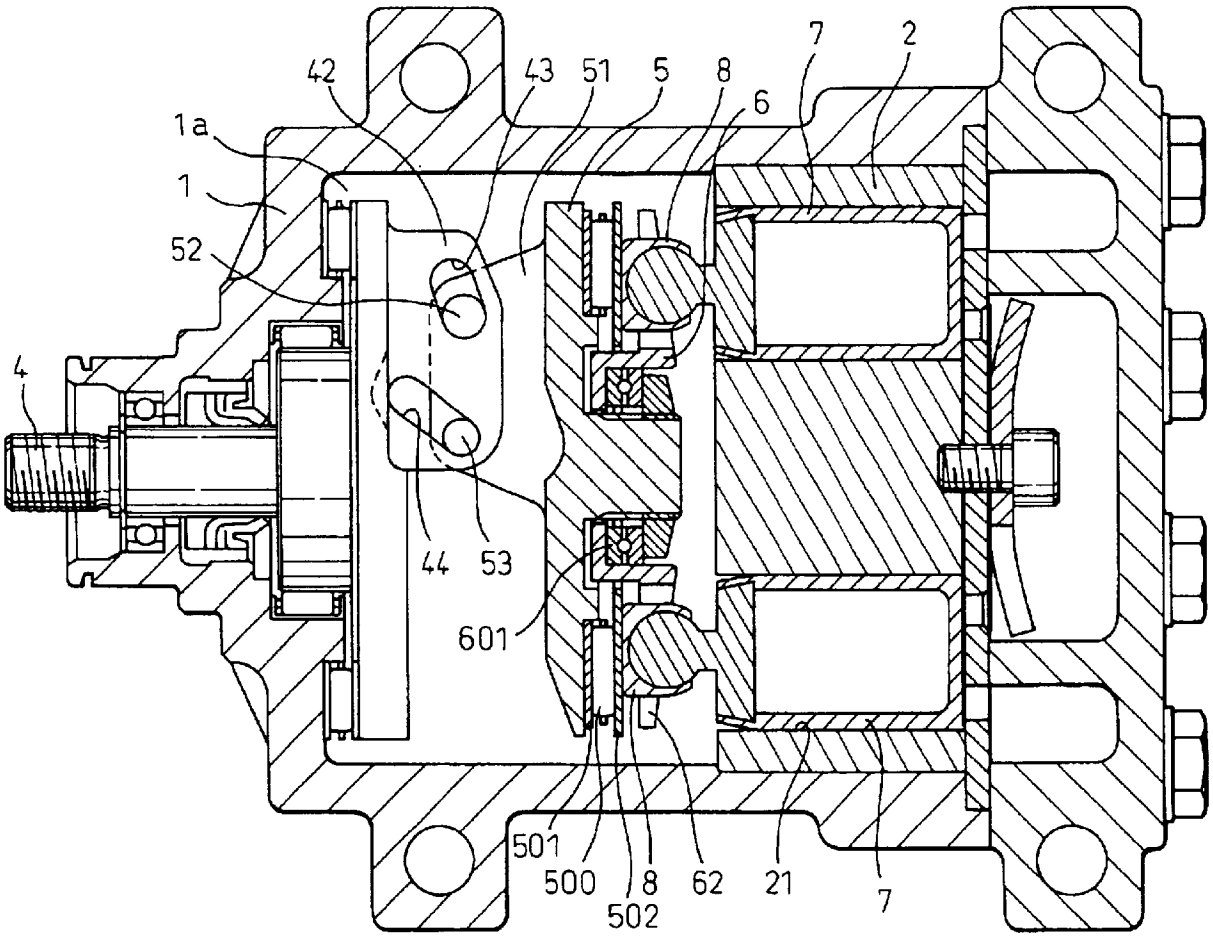
FIG. 2 is a longitudinal sectional front view showing another operating state of the embodiment shown in FIG. 1.
Figure 3:
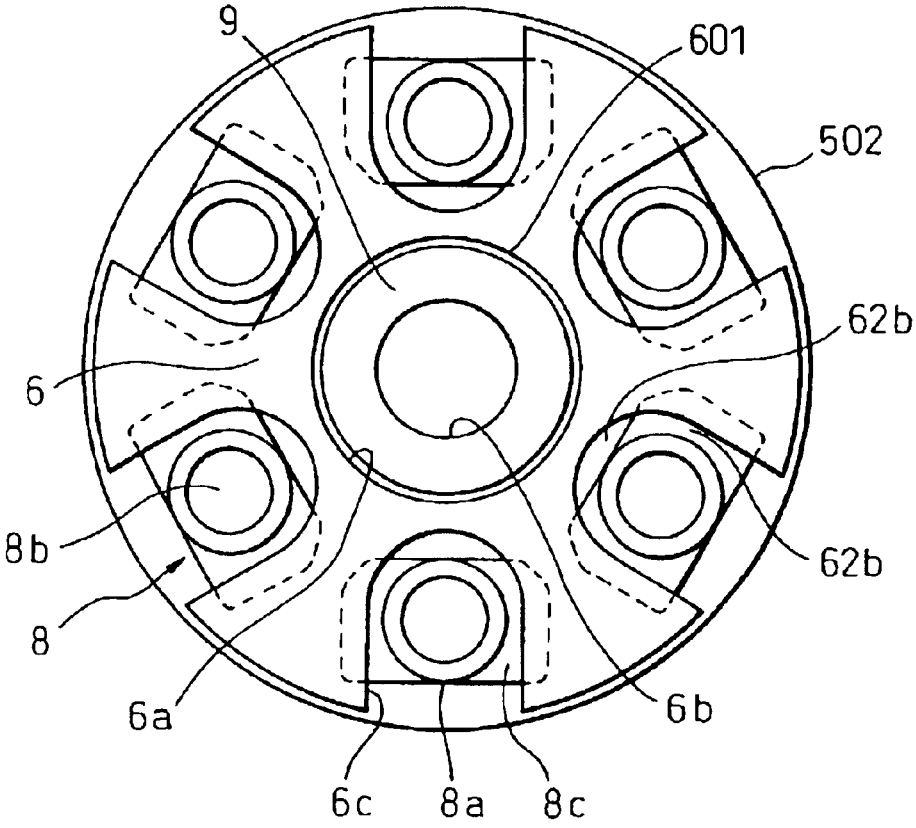
FIG. 3 is a side view illustrating the related parts of a shoe holding plate and shoes.

The specific shape of the shoe holding plate 6 in the first embodiment will be clear if viewing FIG. 3 as well in addition to FIG. 1 and FIG. 2. The shoe holding plate 6 is provided with a circular depression 6*a* at the center and can house the holding plate thrust bearing 601 in that depression 6*a*. At the center of the depression 6*a* is formed a center opening 6*b* for engaging with the shaft part 5*b* of the drive plate 5. At the periphery of the shoe holding plate 6 are formed the exact same number of shoe guide grooves 6*c* formed by radially extending U-shaped cutaway parts as the number of pistons 7 (for example, six).

Figure 4:
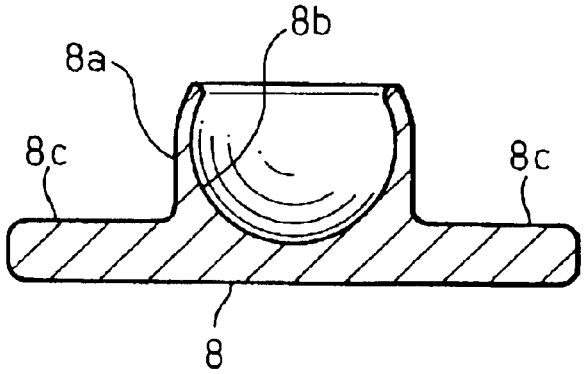
FIG. 4 is a sectional view illustrating the shape of a shoe.

Each shoe guide groove 6*c* has slidably engaged with it a shoe body 8*a* of a shape close to a closed bottom cylinder of a shoe 8 having abrasion resistance of the shape shown in FIG. 3 and FIG. 4. The shoe holding plate 6 is connected rotatably relative to the drive plate 5, but since the shoe bodies 8*a* attached to the pistons 7 are engaged with the shoe guide grooves 6*c* of the shoe holding plate 6, rotation of the shoe holding plate 6 is prevented and only rocking motion is performed along with tilted rotary motion of the drive plate 5. Along with this, some changes occur in the distances among the plurality of shoe bodies 8 on the shoe holding plate 6 and their positions. Therefore, the width and other dimensions of the shoe guide grooves 6*c* of the shoe holding plate 6 are set with some margin so that clearances as shown by reference numerals 62*a* and 62*b* in FIG. 3 are formed with the shoe bodies 8*a*.

Further, each shoe 8 is formed with a shoe flange 8*c* projecting out from the shoe body 8*a* to the sides. Each shoe flange 8*c* is pressed by the two side portions of the corresponding shoe guide groove 6*c* formed in the shoe holding plate 6. Further, as shown in FIG. 4, each shoe 8 is formed with a spherical depression 8*b* into which a spherical end 7*a* formed at one end of a piston 7 is press-fit and locked by calking or another method, whereby the end is engaged with the shoe 8 in a rotatable and slidable manner. The piston 7 to which the shoe 8 is attached is inserted slidably in an above-mentioned cylinder bore 21.

The holding nut 9 screwed over the male thread formed at the shaft part 5*b* of the drive plate 5 presses the shoe holding plate 6 toward the drive thrust bearing 500 and drive plate 5 through the holding plate thrust bearing 601. Due to this, the shoe holding plate 6 simultaneously presses the plurality of shoes 8 on to the drive thrust bearing 500. In this way, the thrust bearing 500, the plurality of shoes 8, the shoe holding plate 6, and the holding plate thrust bearing 601 are assembled on the drive plate 5. The rim part 5*c* of the drive plate 5 is useful for positioning the bearing 500 with respect to the disk part 5*a*. Note that reference numerals 501 and 502 shown in FIG. 1 and FIG. 2 are ring-shaped plates forming part of the drive thrust bearing 500.

Reference numeral 10 is a valve port plate having at least one each of a suction port 10*a* and discharge port 10*b* passing through the same at positions corresponding to each cylinder bore 21. Each suction port 10*a* of the valve port plate 10 is closed off from the suction chamber 31 of the rear housing 3 from the cylinder bore 21 side by part of the suction valve 13 made of a single thin sheet of spring steel. Each discharge port 10*b* is closed off from the discharge chamber 32 side in the rear housing 3 again by part of the discharge valve 11 made of a single thin sheet of spring steel. The discharge valve 11 is simultaneously fastened when a valve holder 12 protecting it is screwed to a valve port plate 10 by a bolt 14. Further, the valve port plate 10 and suction valve 13 are fastened by being gripped between the front housing 1 and cylinder block 2 and the rear housing 3 when these are fastened together as a whole.

Next, the operation of the drive plate type variable capacity compressor of the first embodiment will be explained. When the shaft 4 is driven to rotate by an external power source such as an internal combustion engine or motor mounted in a vehicle, the drive plate 5 connected to the disk part 41 of the shaft 4 through the arm 42, top and bottom guide grooves 43 and 44, two pins 52 and 53, and two arms 51 rotates together with the shaft 4. The shoe holding plate 6, however, is supported with respect to the drive plate 5 through the holding plate thrust bearing 601, and the plurality of shoes 8 engaged with the shoe guide grooves 6*c* engage with the spherical ends 7*a* of the pistons 7, so the plate does not rotate. Therefore, only when the drive plate 5 is tilted with respect to the imaginary plane perpendicular to the shaft 4, the shoe holding plate 6 engages in rocking motion of a magnitude corresponding to its tilt angle while gripping the drive thrust bearing 500 and plurality of shoes 8 with the drive plate 5. Due to this, the plurality of shoes 8 gripped between the shoe holding plate 6 and the drive plate 6 through the drive thrust bearing 500 and the plurality of pistons 7 connected with the same engage in reciprocating motion in the cylinder bores 21.

In the case of the first embodiment, when the two pins 52 and 53 move by sliding in the top guide groove 43 and bottom guide groove 44 at the shaft 4 side, the drive plate 5 and the shoe holding plate 6 change in tilt angle with respect to the plane perpendicular to the shaft 4, so the strokes of all of the pistons 7 change simultaneously by exactly the same amounts. Due to this, the discharge capacity of the compressor changes smoothly.

The working chamber C formed at the top face of each piston in the suction stroke among the plurality of pistons 7 expands and becomes a low pressure, so the fluid to be compressed in the suction chamber 31, for example, the refrigerant of an air-conditioning system, pushes open the suction valve 13 provided at the suction port 10*a* of the valve port plate 10 and flows in. As opposed to this, the working chamber C formed at the top face of each piston 7 in the compression stroke contracts, so the fluid inside it is compressed and becomes a high pressure and pushes open the discharge valve 11 provided at the discharge port 10*b* of the valve port plate 10 to be discharged to the discharge chamber 32. The discharge capacity in this case is generally proportional to the length of the stroke of the piston 7 determined by the tilt angle of the drive plate 5 and the shoe holding plate 6.

If changing the tilt angle of the drive plate 5 and the shoe holding plate 6 in this way, the discharge capacity of the compressor changes, so the discharge capacity may be controlled in the compressor of the first embodiment by changing the pressure in the front housing chamber 1*a* forming the back pressure of all of the pistons 7 using a not shown pressure control valve etc. Normally, a pressure intermediate between the high pressure of the discharge chamber 32 and the low pressure of the suction chamber 31 is introduced from the pressure control valve.

If raising the pressure in the front housing chamber 1*a*, that is, the back pressure of all of the pistons 7, the state of balance with the pressure in the working chamber C formed at the top face of each piston 7 is lost, and the average position of the pistons 7 in the reciprocating motion moves toward a position close to the valve port plate 10 until a new state of balance is obtained. Due to this, the strokes of all of the pistons 7 become smaller, so the discharge capacity of the compressor is smoothly reduced.

FIG. 2 shows the state when the strokes of the pistons 7 become substantially zero and the discharge capacity becomes substantially zero. In this case, the pressure inside the front housing chamber 1*a* becomes maximum and the tilt angle of the drive plate 5 and shoe holding plate 6 becomes substantially zero, so the pistons 7 will be at positions substantially at top dead center and not engage in much reciprocating motion in the cylinder bores 21.

As opposed to this, if a not shown pressure control valve is operated to reduce the pressure in the front housing chamber 1*a*, the back pressure acting on the pistons 7 becomes smaller, so the strokes of all of the pistons 7 become larger all together and the discharge capacity of the compressor becomes smoothly larger. FIG. 1 shows the state where the pressure in the front housing chamber 1*a* becomes minimum so the tilt angle of the drive plate 5 and shoe holding plate 6 becomes larger to the maximum extent and where the strokes of the pistons 7 and the discharge capacity of the compressor become maximum.

The characterizing features of the first embodiment lie in the fact that a plurality of shoes 8 directly engaged with the spherical ends of the pistons 7 are gripped and supported by a single shoe holding plate 6 with the drive plate 5 through the drive thrust bearing 500 and in the fact that the drive plate is connected with the arm 42 on the shaft 4 side using a double slide link mechanism comprised of two guide grooves 43 and 44 and two pins 52 and 53.

Due to this, the large friction that occurred between the drive plate and shoes 8 in a conventional drive plate type variable capacity compressor can be avoided by the thrust bearing 500, so the durability of the shoes 8 and therefore the reliability of the variable capacity compressor are greatly improved.

Further, the frictional loss between the drive plate 5 and the shoes 8 is reduced, so the large advantages are obtained that the mechanical efficiency is improved and the compression efficiency is improved.

Further, when supporting the shaft 4 by radial bearings 402 and 404 provided at the front end of the front housing 1 and connecting the shaft 4 and the drive plate 5 by a double slide link mechanism, there is no longer a need to pass the shaft 4 through the center of the drive plate 5 and extend it to the cylinder block 2. Therefore, it becomes possible to use a small-diameter holding plate thrust bearing 601 for connecting the drive plate 5 and the shoe holding plate 6 etc., so structural limitations are eliminated and therefore it is possible to make the compressor as a whole more compact and its structure becomes more streamlined. This contributes greatly to the reduction of the manufacturing costs.

By way of reference, even if not using a double slide link mechanism, the drive plate 5 and shoe holding plate 6 can be connected to the shaft 4. In this case, however, it is necessary to provide a shaft 4 passing through the center of the drive plate 5 and shoe holding plate 6, so the holding plate thrust bearing 601 used has to be one having dimensions large enough to enable the shaft 4 to be passed through its center. This has the ripple effect of not only making the diameter of the shoe holding plate 6 larger, but also increasing the girth of the compressor as a whole.

Note that as the means for changing the tilt angle of the drive plate 5 and shoe holding plate 6 to change the discharge capacity of the compressor, in the first embodiment, the pressure inside the front housing 1*a* was changed, but the present invention is not characterized by the nature of this means, so it is of course possible to employ any other means enabling the same object to be achieved.

Next, a second embodiment of a variable capacity compressor of the present invention will be explained. The embodiments from the second embodiment shown in FIG. 5 to the sixth embodiment shown in FIG. 9 have as characterizing features the structures of their pistons 7. The rest of the configurations may be made the same as that of the above-mentioned first embodiment, so the explanations of the overall configurations of these embodiments will be omitted and only the detailed structures of the pistons 7 will be explained. Further, parts in common with the above-mentioned first embodiment will be assigned the same reference numerals and explanations omitted.

There are some points in common among the pistons constituting the key parts of these embodiments. The first common point is that all of the pistons have thin, hollow structures. Further, the above-mentioned spherical ends 7*a* are formed integrally at the ends of hollow cylindrical parts by a method such as integral shaping in advance or welding. In this case, only the spherical ends 7*a* are solid. By making almost all of the pistons 7 thin, hollow structures, the inertia forces acting between the spherical ends and shoes 8 become smaller corresponding to the magnitude of the masses of the pistons 7. Due to this, the frictional forces acting on these parts can be reduced and the wear reduced, so the durability becomes higher.

The second common point among these embodiments lies in the selection of the materials used. The aluminum-based material frequently used in the past is not used, but a ferrous material is used. As the material of the cylinder block 2, however, an aluminum-based material continues to be used like in the past. If an aluminum-based material were used for the pistons 7 as well, the sliding surfaces of the cylinder bores 21 and pistons 7 would easily seize up due to friction of the same types of metals, so the sliding surfaces would have to be coated. If a ferrous material is used for the pistons 7, however, seizing no longer easily occurs, so there is no longer a need to coat the surfaces sliding with the aluminum-based material cylinder bores 21.

Note that if a ferrous material is used for the pistons 7, there is the problem that the mass increases compared with use of an aluminum-based material, but this problem can be avoided by making the pistons 7 thin, hollow structures to reduce their weight as explained above. Further, if a ferrous material is used for the pistons 7, since there is no need to coat the surfaces sliding with the aluminum-based material cylinder bores 21, there are the advantages that not only does the cost of the cylinder block 2 and pistons 7 become lower, but also the strength of the pistons 7 becomes remarkably greater.

The third common point among these embodiments is that each of the pistons 7 is provided with a conically shaped shoulder part 7*b*. The conically shaped shoulder part 7*b* smoothly connects the spherical end 7*a* and the cylindrical part 7*c* so makes it difficult for stress to concentrate at the connecting part of the spherical end 7*a* and the cylindrical part 7*c*. Therefore, the strength and durability of the pistons 7 are improved, so the thickness can be reduced and the weight lowered.

Figure 5:
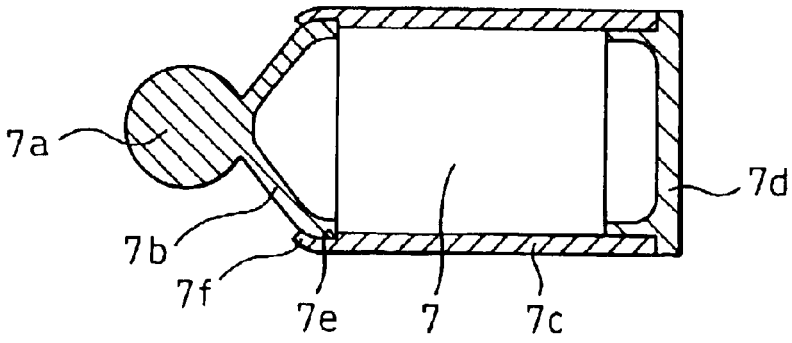
FIG. 5 is a sectional view of the structure of a piston of a second embodiment.

Next, the structural features of the key parts, that is, the pistons 7, of the second embodiment to sixth embodiment will be individually explained. First, the characterizing feature of the piston 7 of the second embodiment shown in FIG. 5 is that the spherical end 7*a* and the hollow conical shoulder part 7*b* connected to it are formed integrally in advance, one end of the hollow cylindrical part 7*c* is joined to the open end of the conical shoulder part 7*b* so as to wrap around it by calking (or welding etc.), and a shallow dish-shaped bottom 7*d* is integrally joined with the other end of the cylindrical part 7*c* by press-fitting, calking, pressure welding, bonding, or another method. Note that to reinforce the connecting part of the conical shoulder part 7*b* and cylindrical part 7*c*, a step part 7*e* and thin part 7*f* are formed at one end of the cylindrical part 7*c*.

Figure 6:
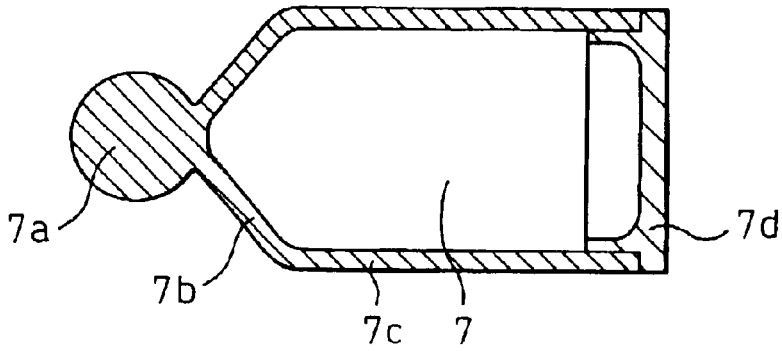
FIG. 6 is a sectional view of the structure of a piston of a third embodiment.

The characterizing feature of the piston 7 of the third embodiment shown in FIG. 6 is that the spherical end 7*a*, conical shoulder part 7*b*, and cylindrical part 7*c* are formed integrally in advance and the bottom 7*d* is integrally joined with the open end of the cylindrical part 7*c* by a method similar to the case of the second embodiment. In the third embodiment, the structure is more streamlined than the second embodiment, so better results than the second embodiment are sometimes obtained in the areas of cost, strength, etc.

Figure 7:
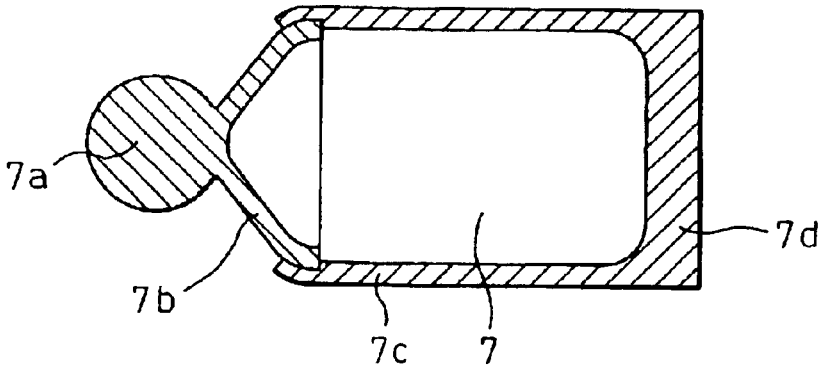
FIG. 7 is a sectional view of the structure of a piston of a fourth embodiment.

The characterizing feature of the piston 7 of the fourth embodiment shown in FIG. 7 is that the cylindrical part 7*c* and bottom 7*d* are formed integrally in advance and the conical shoulder part 7*b* is integrally joined with the open end of the cylindrical part 7*c* by a method similar to the case of the second embodiment. In this case as well, better results than the second embodiment are sometimes obtained in the areas of cost, strength, etc.

Figure 8:
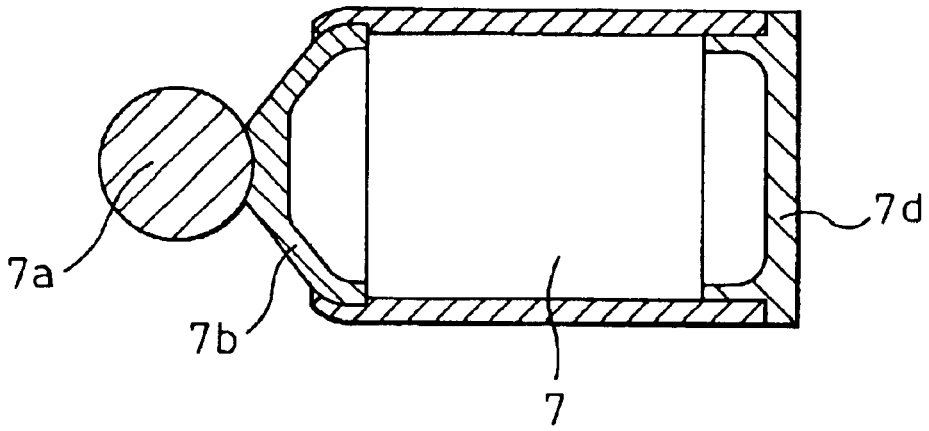
FIG. 8 is a sectional view of the structure of a piston of a fifth embodiment.

The characterizing feature of the piston 7 of the fifth embodiment shown in FIG. 8 is that the conical shoulder part 7*b*, cylindrical part 7*c*, and bottom 7*d* are integrally joined by a method similar to the case of the second embodiment, but the spherical end 7*a* is fabricated separately from these, then integrally joined with the front end of the conical shoulder part 7*b* by a method such as welding. Since the parts are fabricated separately in advance, fabrication of the relatively difficult spherical end 7*a* etc. becomes easy, but there are the defects that the cost for integrally joining the parts swells or the strength sometimes becomes inferior to that of the above embodiments.

Figure 9:
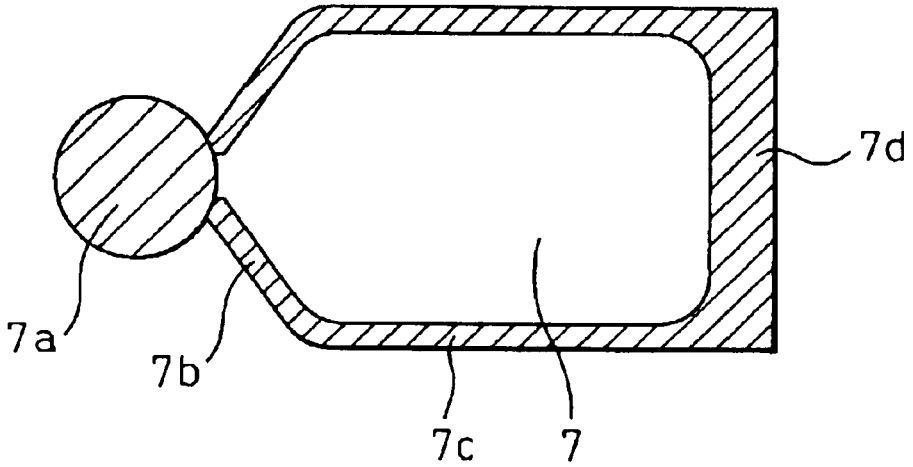
FIG. 9 is a sectional view of the structure of a piston of a sixth embodiment.

The characterizing feature of the piston 7 of the sixth embodiment shown in FIG. 9 is that the conical shoulder part 7*b*, cylindrical part 7*c*, and bottom 7*d* are formed integrally in advance and the spherical end 7*a* is fabricated separately from these, then integrally joined with the front end of the conical shoulder 7*d* by a method such as welding. In this case as well, the fabrication of the relatively difficult spherical end 7*a* becomes easy, but depending on the method of welding the spherical end 7*a* to the conical shoulder part 7*b*, the strength sometimes becomes inferior to the embodiments explained above.

FIG. 10 to FIG. 14 show a seventh embodiment of the present invention. In general, in a variable capacity compressor of the type where the discharge capacity automatically changes by the balance between the compression reaction force in the working chambers C and the back pressure of the pistons 7 such as the pressure in the front housing chamber 1*a*, when the engine is started and the compressor starts turning along with that, to reduce the load on the engine and ease the shock at the time of start of rotation, it is preferable to stop in the small capacity state. Therefore, a spring imparting force in a direction reducing the tilt angle of the drive plate is provided. As shown in FIG. 2, however, at a time such as when resuming operation from a state where the tilt angle of the drive plate 5 becomes substantially zero or minimal and the operation is stopped, in the operating state when increasing the tilt angle from zero or its minimum value as shown in FIG. 1, first the stroke of each piston 7 is extremely small and the fluid performs almost no compression work in the working chamber C, so the pressure in the working chamber C is low and therefore the force making the drive plate 5 tilt as shown in FIG. 1 is weak and the rise in the discharge capacity becomes slow. Therefore, the response becomes a problem when it is necessary to quickly increase the discharge capacity. To solve this problem, in a variable capacity compressor of the conventional type where the shaft passes through the center of the drive plate and extends to the inside of the cylinder block, coil springs are provided at the two sides of the drive plate at the position where the shaft passes through the drive plate and the drive plate is biased in a direction increasing its tilt angle by the force of the two compression coil springs pushing against each other.

Figure 14:
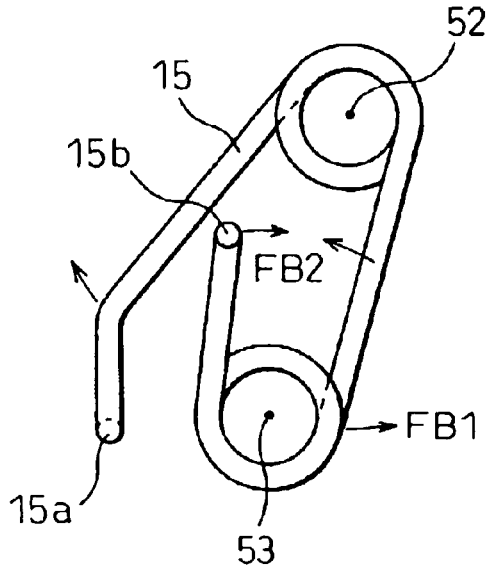
FIG. 14 is a view showing only the torsion coil spring of the seventh embodiment.

In the variable capacity compressor of the present invention, however, one of the characterizing features is that basically the shaft 4 does not pass through the drive plate 5. The drive plate 5 is supported in a cantilever manner by the shaft 4, so it is not possible to provide such two compression coil springs. Therefore, in the seventh embodiment, instead of the two compression springs, a single torsion coil spring 15 such as shown in FIG. 14 is provided to solve this problem.

Figure 10:
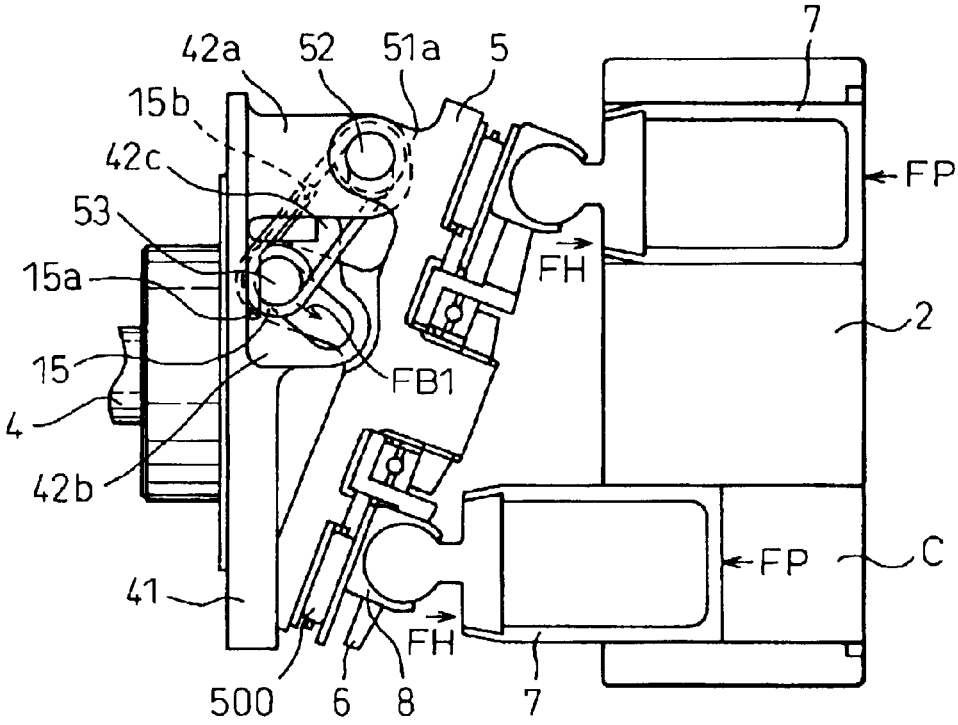
FIG. 10 is a partial longitudinal sectional view showing an operating state where a variable capacity compressor of a seventh embodiment gives its maximum discharge capacity.
Figure 11:
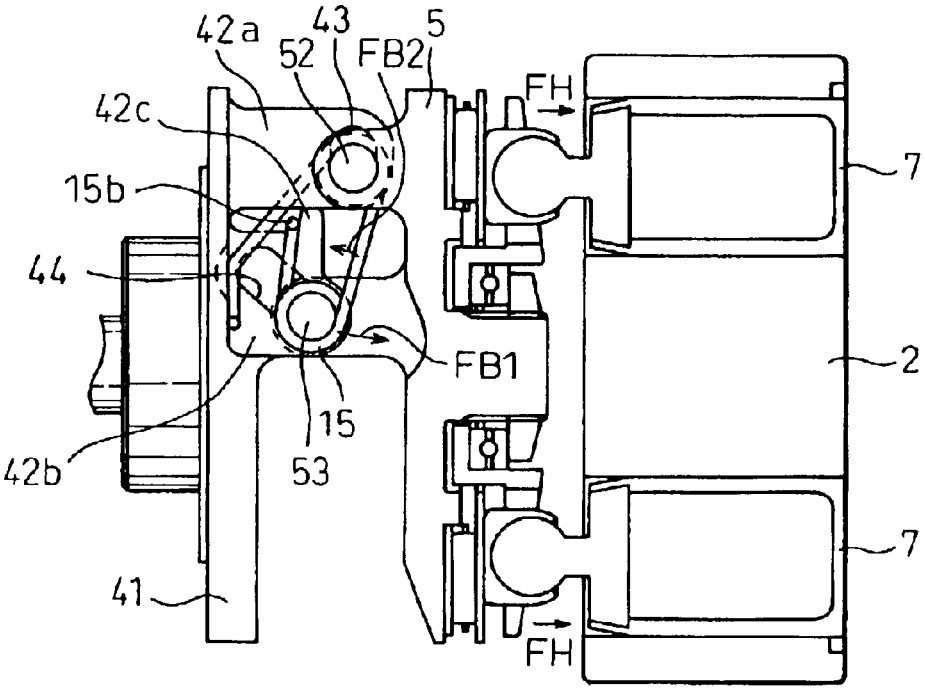
FIG. 11 is a partial longitudinal sectional view showing an operating state where the discharge capacity of the variable capacity compressor of the seventh embodiment is zero.
Figure 12:
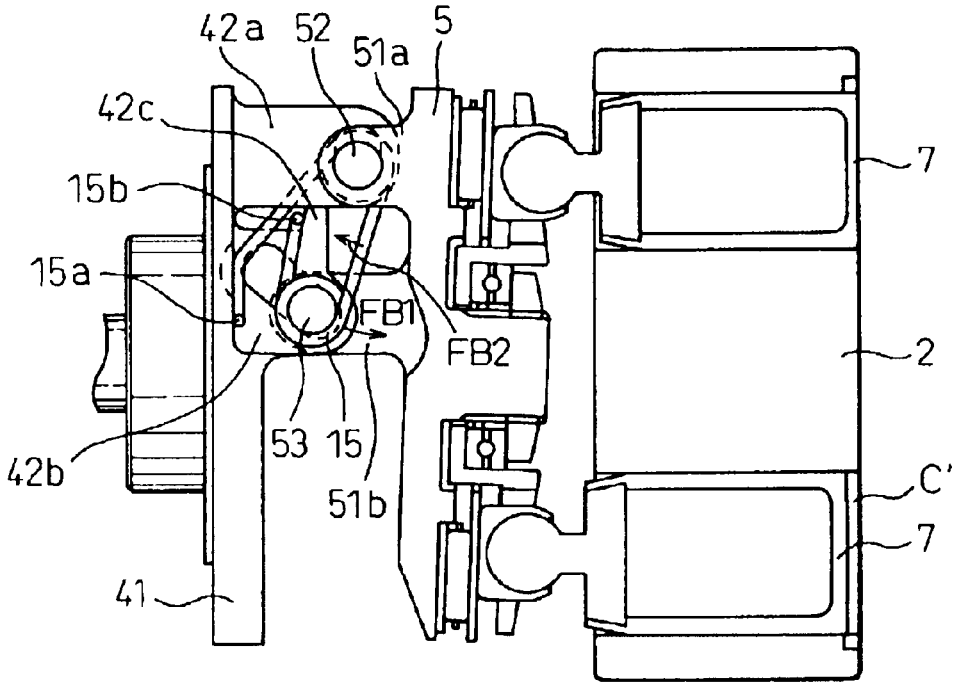
FIG. 12 is a partial longitudinal sectional view showing an operating state where the variable capacity compressor of the seventh embodiment gives its substantially minimum discharge capacity.
Figure 13:
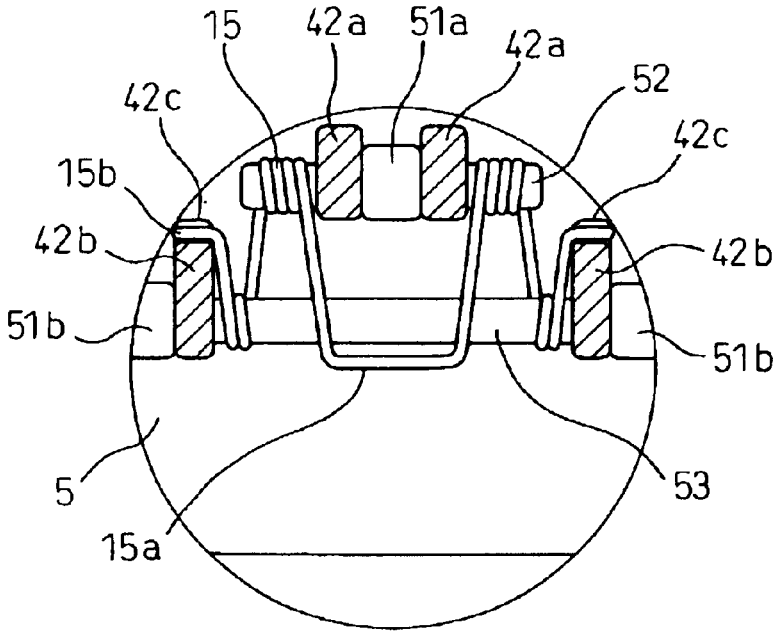
FIG. 13 is a side view showing a torsion coil spring, one feature of the seventh embodiment, and partially cutaway related parts.

The shape of the torsion coil spring 15 and the states of engagement of the parts will be clear from viewing any of FIG. 10 to FIG. 12 and FIG. 13. That is, the torsion coil spring 15 has a left-right symmetrical shape as shown in FIG. 13. The part called the "front spring arm 15*a*" at the center is designed to engage with the surface of the disk part 41 of the shaft 4 as shown in FIG. 12. The parts at the two sides of the torsion coil spring 15 are wrapped around the top pin 52 supported by the single top arm 51*a* of the drive plate 5, then wrapped around the bottom pin 53 supported by the pair of bottom arms 51*b*, and further extended to form the pair of rear spring arms 15*b* at the two ends. The front end parts of the rear spring arms 15*b* are designed to engage with projecting tabs 42*c* of the bottom arms 42*b* provided at the disk part 4 when the tilt angle of the drive plate 5 becomes zero or minimal as shown in FIG. 11 and FIG. 12 and to separate from the tabs 42*c* when the tilt angle of the drive plate 5 becomes greater than a predetermined value as shown in FIG. 10.

The torsion coil spring 15 generates a force FB1 biasing the drive plate 5 in a direction where the tilt angle becomes zero or minimum by the elasticity of the parts wrapped around the top pin 52. This force FB1 continuously acts on the drive plate 5 through the bottom pin 53 since the front spring arm 15*a* is in constant contact with the surface of the disk part 41. Further, the torsion coil spring 15 can generate a force FB2 biasing the drive plate 5 in a direction increasing the tilt angle by the elasticity of the parts wrapped around the bottom pin 53. This force FB2, however, effectively acts to increase the tilt angle of the drive plate 5 and cancel out the force FB1 only at the time such as shown in FIG. 11 or FIG. 12 when the front ends of the front spring arm 15*a* engage with the tabs 42*c*, that is, when the tilt angle of the drive plate 5 is close to zero or the minimum. When the tilt angle of the drive plate 5 has a magnitude of more than a predetermined value such as in the case shown in FIG. 10, the front ends of the front spring arm 15*a* separate from the tabs 42*c* serving as the catch holds, so do not act effectively. Therefore, in such an operating state, the torsion coil spring 15 generates only the force FB1. Due to such an action, the torsion coil spring 15 can bias the drive plate 5 in a direction where the tilt angle is reduced in the state where the tilt angle of the drive plate 5 is large and in a direction where the tilt angle is increased in the state where the tilt angle becomes zero or minimal.

Since the variable capacity compressor of the seventh embodiment is provided with a single torsion coil spring having such an action, when the operation is stopped as shown in FIG. 12 or in an operating state where the discharge capacity becomes zero or minimal as shown in FIG. 11, the force FB2 is generated and acts in a direction making the tilt angle of the drive plate 5 increase, so at the time of stoppage where the back pressure FH in the front housing chamber 1*a* does not act on the pistons 7 or in an operating state right after the start of operation where the back pressure FH does not sufficiently rise, the drive plate 5 is forced to take a predetermined tilt angle by the force FB2 and enters the state as shown in FIG. 12. Note that when making the discharge capacity zero or minimal during operation as shown in FIG. 11, the pressure FH in the front housing chamber 1*a* is high and the compression reaction force FP in the working chambers C is small, so even if the force FB2 due to the torsion coil spring 15 acts, the tilt angle of the drive plate 5 becomes zero or minimal. Therefore, even if the torsion coil spring 15 is provided, it does not obstruct the control of the discharge capacity.

Figure 15A:
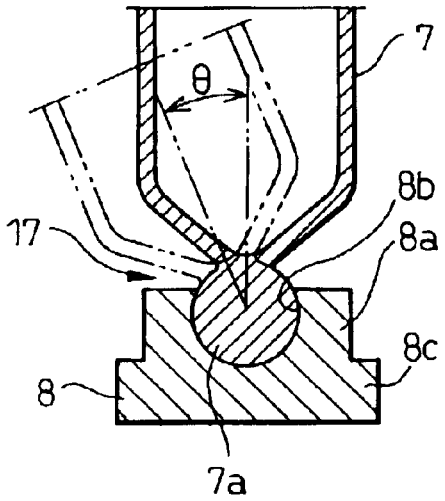
FIG. 15A is a longitudinal sectional view showing key parts of an eighth embodiment.

Next, as an eighth embodiment of the variable capacity compressor of the present invention, an embodiment characterized by the structure of the ball joint connecting the spherical end 7*a* at one end of each piston 7 and a shoe 8 or the method of production thereof will be explained. The eighth embodiment is characterized by only the ball joint part, so the rest of the configuration may be made the same as in the other embodiments. In the eighth embodiment of the present invention, as shown in FIG. 15A, first the piston 7 and its spherical end 7*a* are fabricated, then a predetermined casting mold is used to cast the shoe 8 so as to surround the spherical end 7*a*. Due to this, at the same time as the formation of the shoe body 8*a* and shoe flange 8*c*, the joint part 17 is formed all at once. The spherical depression 8*b* formed automatically at the shoe 8 side is obtained by transfer of the spherical surface of the spherical end 7*a* of the piston 7 side, so the surface roughness and other surface properties are similarly transferred. Therefore, machining etc. of the spherical depression 8*b* become unnecessary. Further, since it is easy to make the shoe body 8*a* around the spherical end 7*a* thick, the tensile strength of the joint part 17 formed by casting can be made extremely high.

Figure 15B:
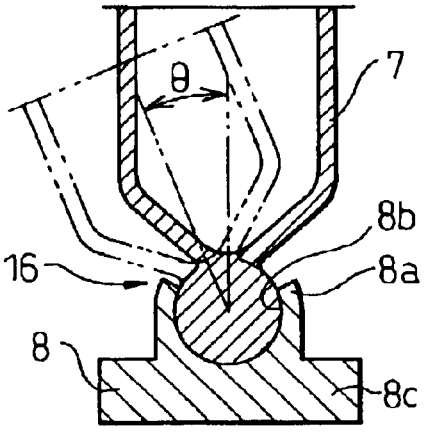
Fig. 15B PRIOR ART
FIG. 15B is a longitudinal sectional view showing a prior art for comparison with the eighth embodiment.

For comparison, a joint part 16 obtained by calking as practiced in the past is shown in FIG. 15B. In this case as well, the spherical end 7*a* at the piston 7 side is first formed, then the shoe body 8*a* of the shoe 8 is calked around the spherical end 7*a*, but there is a limit to the calkable thickness of the shoe body 8*a*, so it is difficult to raise the tensile strength of the joint part 16 formed by calking. Further, even if the surface properties of the spherical depression 8*b* of the shoe 8 deteriorates due to the calking, it is difficult to correct this by machining etc. Conversely, the fact that this problem does not arise can be said to be an advantage of a joint part 17 formed by casting.

Figure 16A:
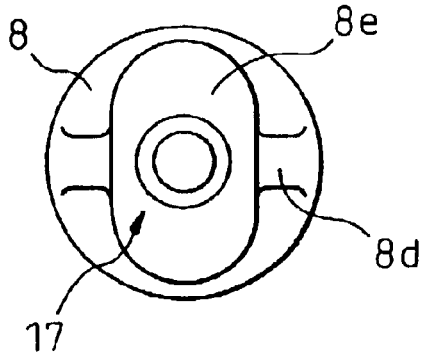
FIG. 16A is a plan view showing a specific example of the eighth embodiment.
Figure 16B:
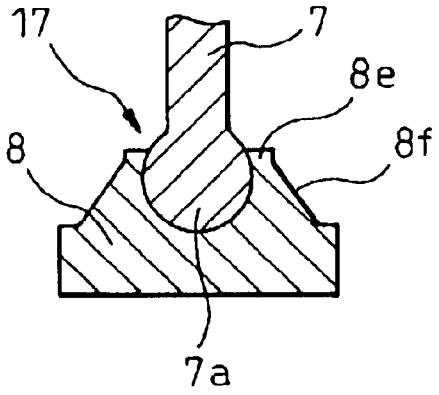
FIG. 16B is a longitudinal sectional view of the eighth embodiment.

FIGS. 16A and 16B show specific examples of a shoe 8 having the joint part 17 formed by casting. In each case, formation is difficult by the conventional method using calking. That is, in the case of FIG. 16A, the shoe body forming the joint part 17 formed by casting of the shoe 8 is oval in shape. Further, reinforcement ribs 8*d* are formed at the short width portion of the oval shaped shoe body 8*e*. Even if the shoe 8 has such a complicated shape, it is possible to easily obtain it since the eighth embodiment uses casting. In the case of FIG. 16B, the body of the shoe 8 is provided with a taper surface 8*f*, but it is possible to easily form the joint part 17 by casting by surrounding the spherical end 7*a* of the piston 7 by casting.

Figure 17A:
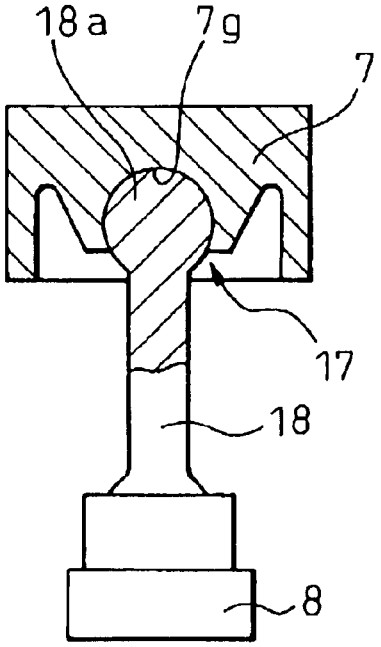
FIG. 17A is a longitudinal sectional view showing an example of application of the eighth embodiment.

The joint part 17 formed by casting is not limited to the case where the spherical end 7*a* is formed directly at the end of the piston 7. As shown in FIG. 17A, when a spherical depression 7*g* is formed at part of the piston 7 and a spherical end 18*a* of a connecting rod 18 is connected with this, it is possible to form the joint part 17 by casting by first fabricating the spherical end 18*a* of the connecting rod 18 and then casting the piston 7 so as to surround this.

Figure 17B:
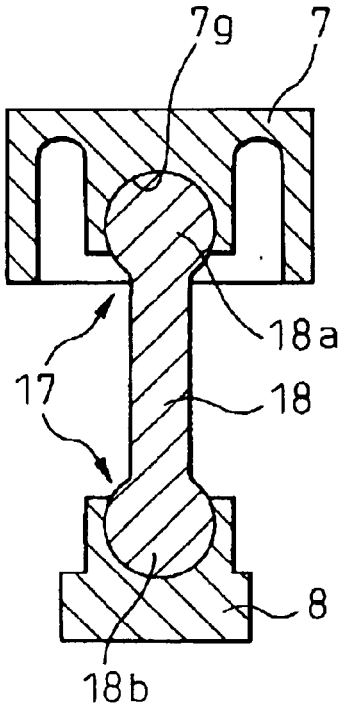
FIG. 17B is a longitudinal sectional view showing another example of application of the eighth embodiment.

Further, as shown in FIG. 17B, not only is it possible to form the joint part 17 by casting between the piston 7 and one end of the connecting rod 18, but it is also possible to form the joint part 17 by casting between the spherical end 18*b* formed at the other end of the connecting rod 18 and the shoe 8. In this case, the spherical end 18*b* is formed in advance at the other end of the connecting rod 18 and then the shoe 8 is cast so as to surround the spherical end 18*b*.

Figure 18:
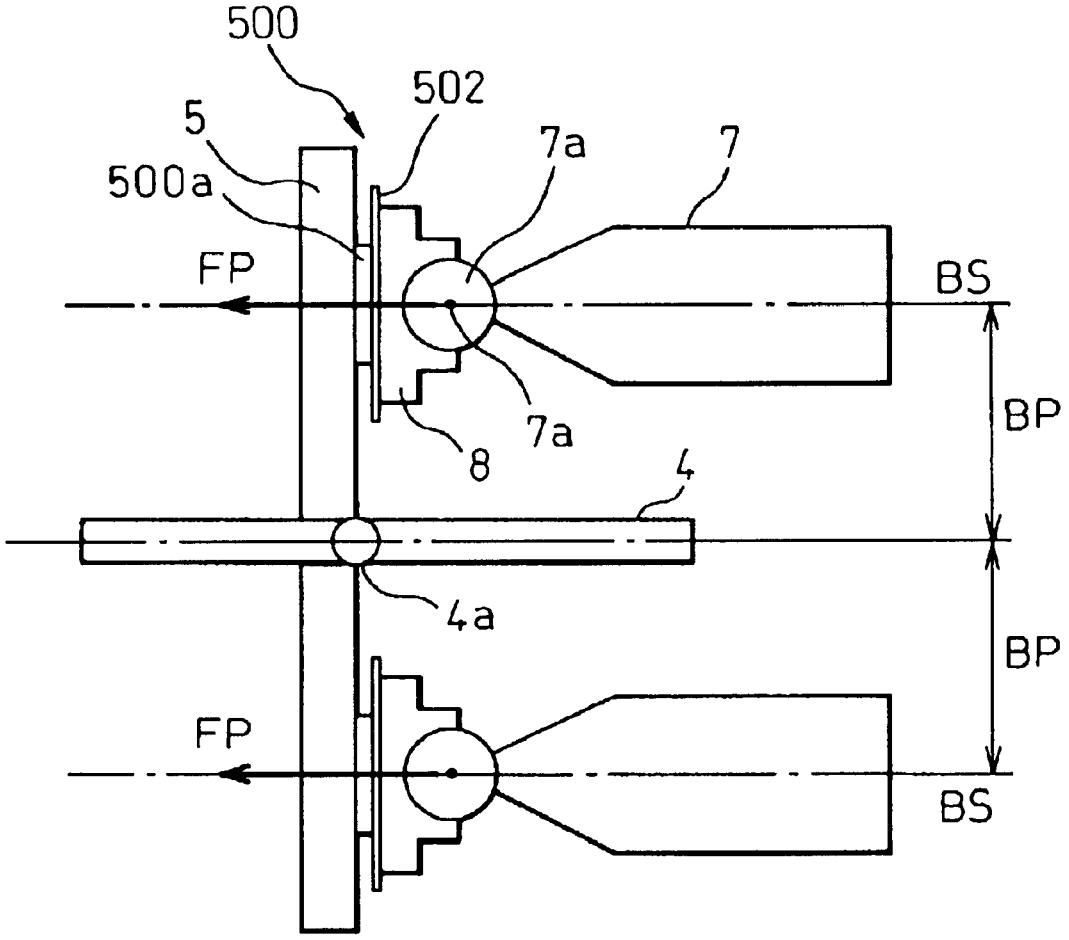
FIG. 18 is a conceptual view showing the positional relationship and force relationship when the tilt angle of a drive plate is zero.
Figure 19:
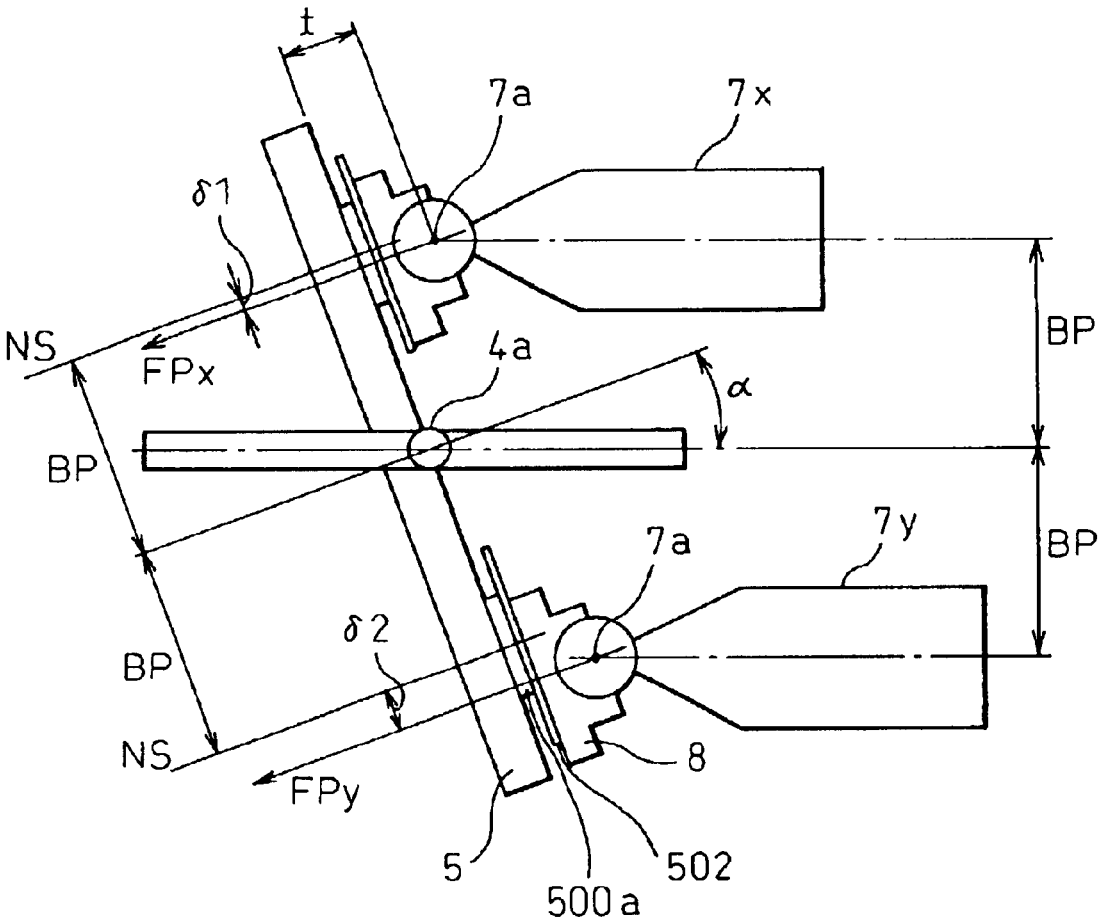
FIG. 19 is a conceptual view showing the positional relationship and force relationship when the tilt angle of a drive plate is large.

Next, a ninth embodiment of the present invention will be explained. The variable capacity compressor of the ninth embodiment is characterized by the improvement of the drive thrust bearing 500 provided between the drive plate 5 and the shoe 8. For the drive thrust bearing 500 provided at this portion, it is preferable to use a so-called needle bearing having rollers (needle rollers) long in the radial direction for the following reasons. FIG. 18 and FIG. 19 are schematic views showing the positional relationships of the drive plate 5, pistons 7, shoes 8, and drive thrust bearing 500 and the relationship of the forces acting on them. In the state shown in FIG. 18 where the discharge capacity is zero or minimal, the drive plate 5 is substantially perpendicular to the shaft 4, so in this example the center parts of the radially arranged elongated rollers 500*a* are designed to be on the center axial line BS of the cylinder bore 21 and piston 7. This is the most preferable mode where the pushing force FP from a piston 7 is applied to the center part of the roller 500*a* in its longitudinal direction (radial direction of drive plate 5).

In the case of the above design, the state where the drive plate 5 is made to tilt by exactly the angle about the center of tilt 4*a* shown by reference numeral 4*a* in the figure is shown in FIG. 19. In FIG. 19, the line passing through the center parts of the rollers 500*a* and perpendicularly intersecting with the same is designated as NS, the directional lines of force from the two pistons 7 positioned at the bottom dead center and top dead center are designated as FPx and FPy, and the distance from the center axis of the shaft 4 to the center axis BS of a piston 7 is designated as BP.

As will be clear from FIG. 19, due to tilting of the drive plate 5, the direction of the force is offset from the center part of the roller 500*a*. At the piston 7*x* at the bottom dead center, the directional line FPx of the force moves inward from the center parts of the rollers 500*a*. Further, at the piston 7*y* at the top dead center, the directional line FPy of the force moves outward from the center parts of the rollers 500*a*. The position of the force acting on the rollers 500*a* is most preferably at the center parts, so it is necessary to avoid having force act on the ends of the rollers 500*a*. Therefore, the rollers 500*a* have to be as long as possible.

Figure 20:
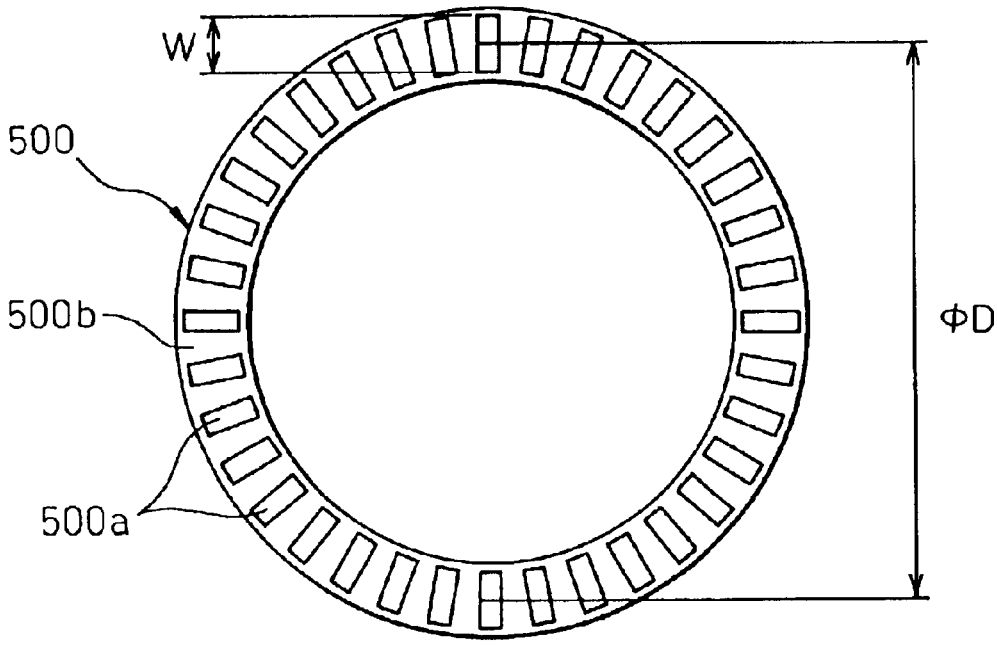
Fig.20 PRIOR ART
FIG. 20 is a conceptual view showing a conventional type of needle bearing able to be used as a drive thrust bearing.
Figure 21:
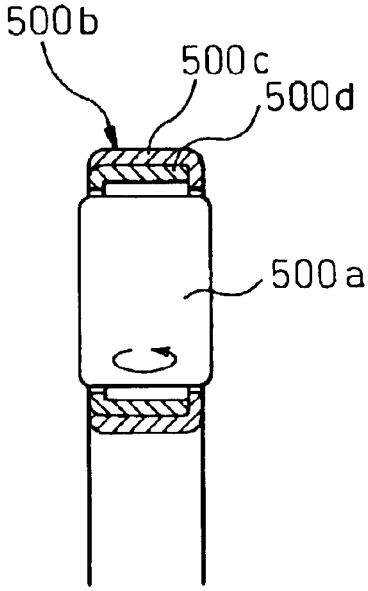
Fig.21 PRIOR ART
FIG. 21 is a sectional view of the needle bearing shown in FIG. 20.
Figure 22:
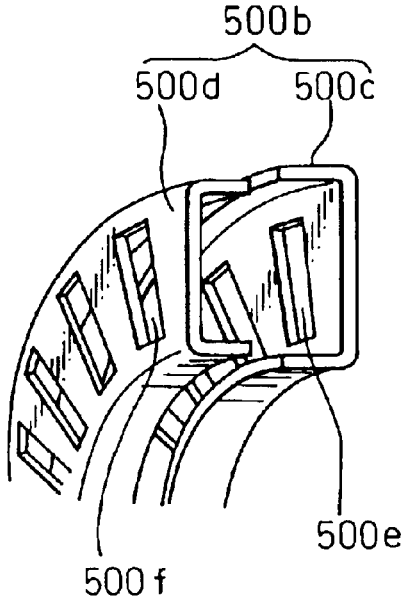
Fig.22 PRIOR ART
FIG. 22 is a perspective view of a holder of a conventional type of needle bearing.

In general, however, in a radially arranged needle thrust bearing, the rollers do not only engage in rolling contact in the strict sense with the opposing surfaces straddling them. A slip of a magnitude corresponding to the length of the rollers or the radius of the opposing surfaces at positions where the rollers are engaged arises. The structure of a conventional type of needle thrust bearing able to be used as the drive thrust bearing 500 in the variable capacity compressor of the present invention is illustrated from FIG. 20 to FIG. 22. The large number of rollers 500*a* arranged on a single circle maintain predetermined intervals by a cage-like holder 500*b*. The holder 500*b* is comprised of two holder halves 500*c* and 500*d* assembled with each other. These halves are formed with window-like openings 500*e* and 500*f* through which the rollers 500*a* are exposed.

In a conventional type of thrust bearing having such a structure, if the diameter of the circle connecting the center parts of all of the rollers 500*a* is designated as $\phi D$ and the length of the rollers 500*a* as W, a slip of a slip ratio $W/2\pi D$ occurs at the outer ends of the rollers 500*a* and a slip of a slip ratio $-W/2\pi D$ occurs at the inner ends. Therefore, when the radius of the circle at which the center parts of all of the rollers 500*a* engage is the same, the absolute values of the slip ratios become proportional to the length of the rollers 500*a*. Of course, the smaller the slip ratio, the better. While also depending on the load conditions, if the slip ratio becomes too great, the lifetime of the drive thrust bearing 500 becomes shorter.

On the other hand, in the variable capacity compressor of the present invention, it is necessary to provide a drive thrust bearing 500 able to support a large load between the drive plate 5 and the shoes 8 of the pistons 7, so it becomes necessary to use a needle thrust bearing having long rollers 500*a* as explained above. This however runs counter to the demand for increasing the lifetime of the bearing. Therefore, in a ninth aspect of the present invention, these two demands are simultaneously met by the provision of a drive thrust bearing 500 having a small slip ratio while having a sufficiently high load bearing capability.

Figure 23:
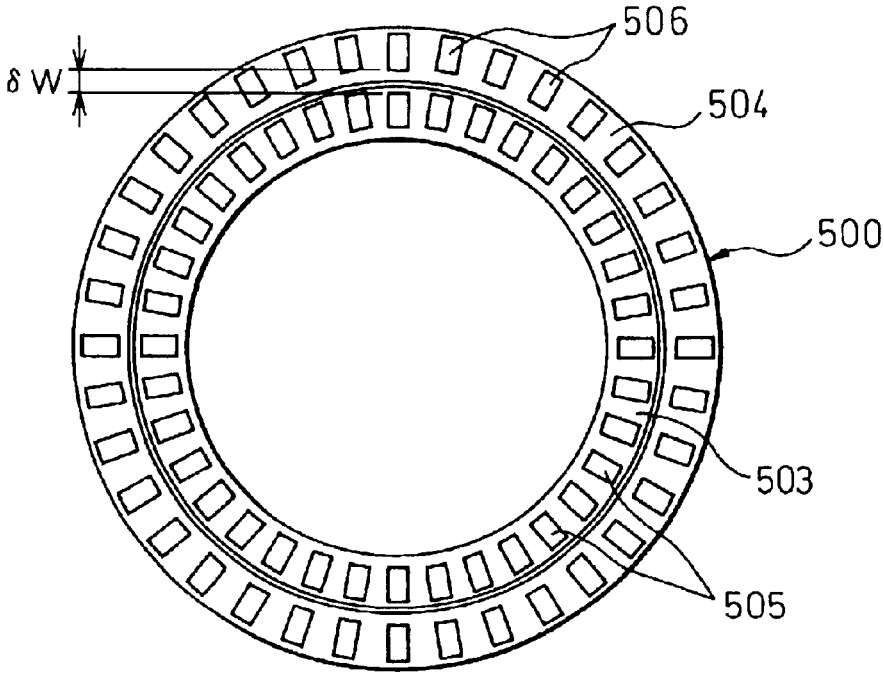
FIG. 23 is a conceptual view of a drive thrust bearing constituting a key part of a ninth embodiment.

As shown in FIG. 23, the drive thrust bearing 500 in the ninth embodiment of the present invention is characterized by the arrangement of a large number of short rollers divided in groups among on a plurality of concentric circles. Therefore, in the ninth embodiment, a concentric circular plurality of holders 503 and 504 are used and the large number of short rollers 505 and 506 are held independently by these holders 503 and 504. The rollers 505 and 506 are all short, so the difference between the peripheral speed of the outer ends and the peripheral speed of the inner ends becomes small and the slip ratio also becomes small.

Figure 24:
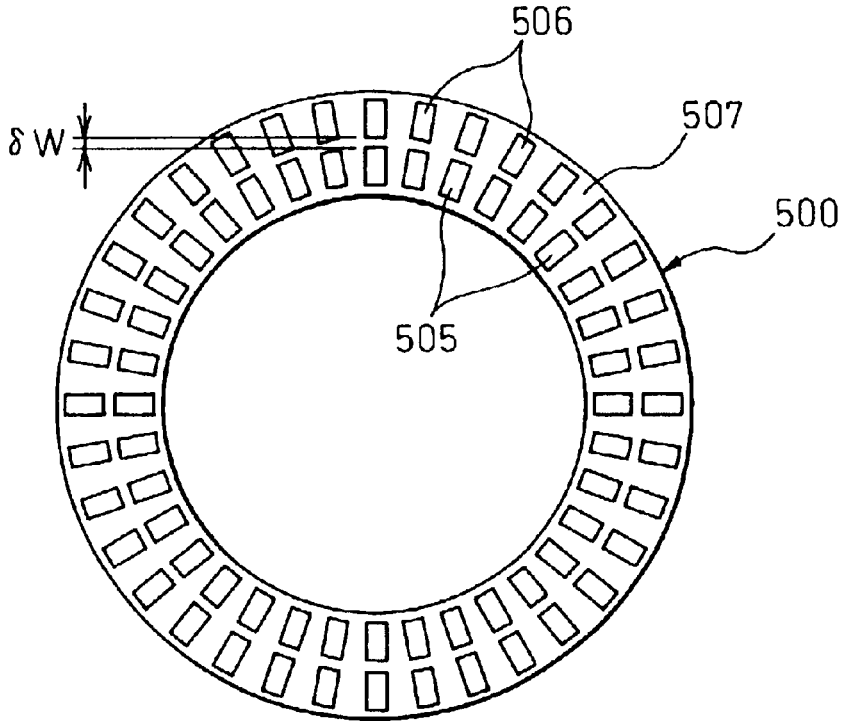
FIG. 24 is a conceptual view of a drive thrust bearing constituting a key part of a 10th embodiment.

The drive thrust bearing 500 forming the key part of the 10th embodiment conceived from roughly similar thinking is shown in FIG. 24. In the 10th embodiment as well, an inside and outside row of short rollers 505 and 506 are used, but in this case the rollers 505 and 506 are held by a single holder 507. If using separate holders 503 and 504 as in the above-mentioned ninth embodiment, it is necessary to make the interval δW between the inside and outside rollers 505 and 506 relatively large, so the outside diameter of the drive thrust bearing 500 as a whole becomes larger, but if a single holder 507 is used as in the 10th embodiment, the interval δW becomes small, so the outside diameter of the drive thrust bearing 500 as a whole can be made relatively small.

Figure 25:
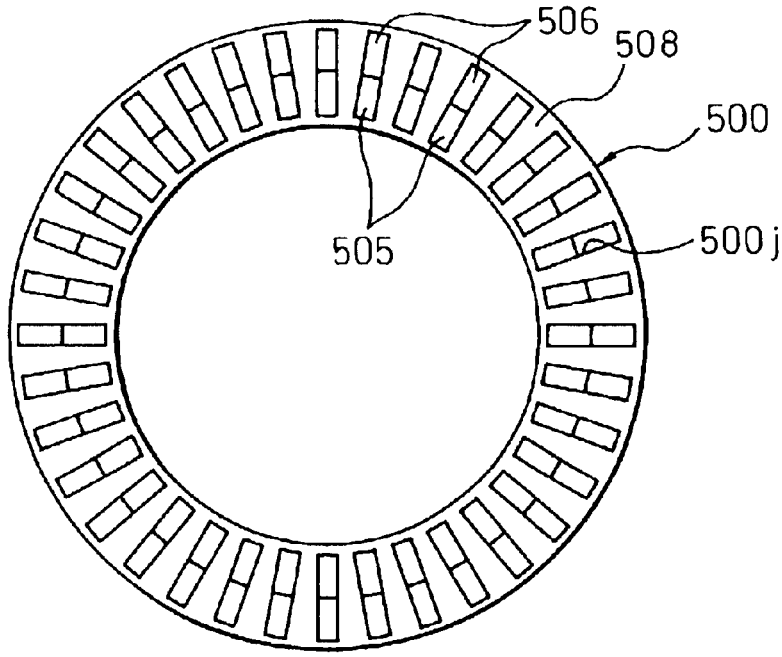
FIG. 25 is a conceptual view of a drive thrust bearing constituting a key part of an 11th embodiment.

The thinking of the 10th embodiment is taken further in the 11th embodiment shown in FIG. 25. In this case, a single holder 508 is used and the inside and outside rollers 505 and 506 are exposed at the same window openings. There is a slight difference in the rotational speeds of the rollers 505 and 506, but the difference is small, so is almost no problem. In the 11th embodiment, the interval δW becomes zero, so the outside diameter of the drive thrust bearing 500 as a whole can be made smaller than the case of the ninth embodiment or 10th embodiment. In either case, by using a large number of short rollers 505 and 506 arranged on a plurality of concentric circles, it becomes possible to increase the load bearing capacity of the drive thrust bearing 500 while keeping down any increase in the slip ratio.

When changing the discharge capacity in a variable capacity compressor like in the present invention, it is necessary to raise the pressure in the front housing chamber 1*a* and bias the piston 7 in the direction of the cylinder block 2, so the shoe 8 is strongly pressed toward the ring-shaped plate 502 or the shoe holding plate 6. This force differs depending on discharge capacity, diameter of the pistons 7, and other dimensions of the compressor, but is for example 150N in the case of a refrigerant compressor having a diameter of the pistons 7 of 31 mm and using HFC-134a as a refrigerant. For example, even if the diameter of the pistons 7 is 20 mm, the force reaches about 500N.

On the other hand, during operation, relative sliding occurs between the shoes 8 and the shoe holding plate 6, though slight in distance, so it is preferable to make the contact surfaces larger to smooth the sliding. If making the flanges 8*c* of the shoes 8 larger to increase the sliding contact surfaces with the shoe holding plate 6, with circular shoes like those used in the past, geometric interference would occur between one shoe 8 and another shoe 8 or with other members.

Figure 26:
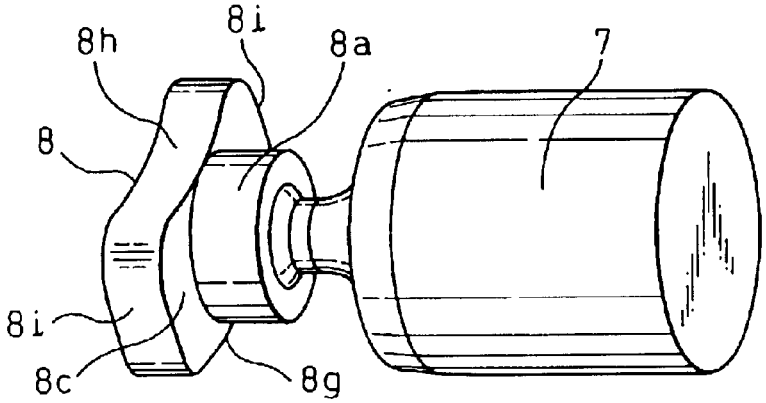
FIG. 26 is a perspective view of key parts of a 12th embodiment of the present invention.
Figure 27:
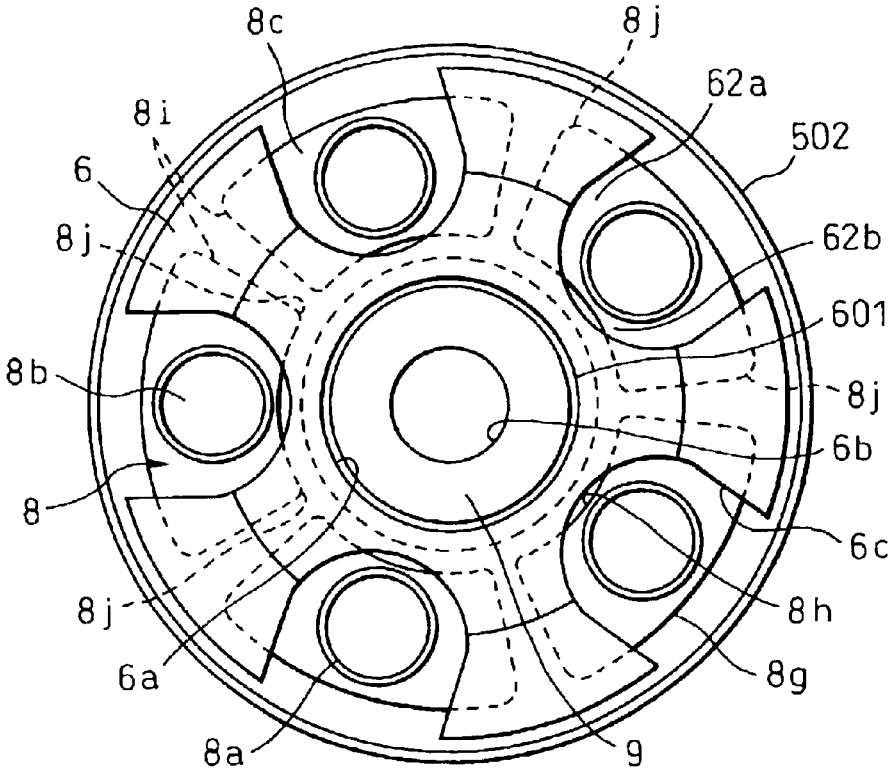
FIG. 27 is a side view of related parts of a shoe holding plate and shoes in a 12th embodiment.

As a means to deal with this problem, a 12th embodiment of the present invention shown in FIG. 26 and FIG. 27 will be explained. The 12th embodiment is characterized by the shape of the shoe 8, in particular the shape of the shoe flange 8*c* coming into sliding contact with the shoe holding plate 6. The shape can be concisely expressed as being "generally fan-shaped". Note that in the first embodiment, as shown in FIG. 3, the shoe flange 8*c* is made generally rectangular, so the contact area with the shoe holding plate 6 becomes larger than with the conventional circular shoe, but the contact area is slightly smaller than with a shoe 8 where the shoe flange 8*c* is made as large as possible as in the 12th embodiment. The shoe flange 8*c* in the 12th embodiment has an outer peripheral surface 8*g* and an inner peripheral surface 8*h* formed as arcuate surfaces generally concentric with the outer circumferential surface of the shoe holding plate 6 and has two side surfaces 8*i* flat in the radial direction so as to make the area of the shoe flange 8 as large as possible. Note that the four corners 8*j* are suitably rounded.

The not shown overall configuration of the variable capacity compressor of the 12th embodiment is similar to that of the first embodiment shown in FIG. 1 and FIG. 2. The slight point of difference, as clear from FIG. 27 corresponding to FIG. 3, is that in the 12th embodiment, there are five pistons 7 and cylinder bores 21, or one less than the first embodiment, and there are five shoe guide grooves 6*c* of the shoe holding plate 6. Therefore, it is possible to make the area of the shoe flange 8*c* larger than in the first embodiment from this viewpoint as well.

Figure 28:
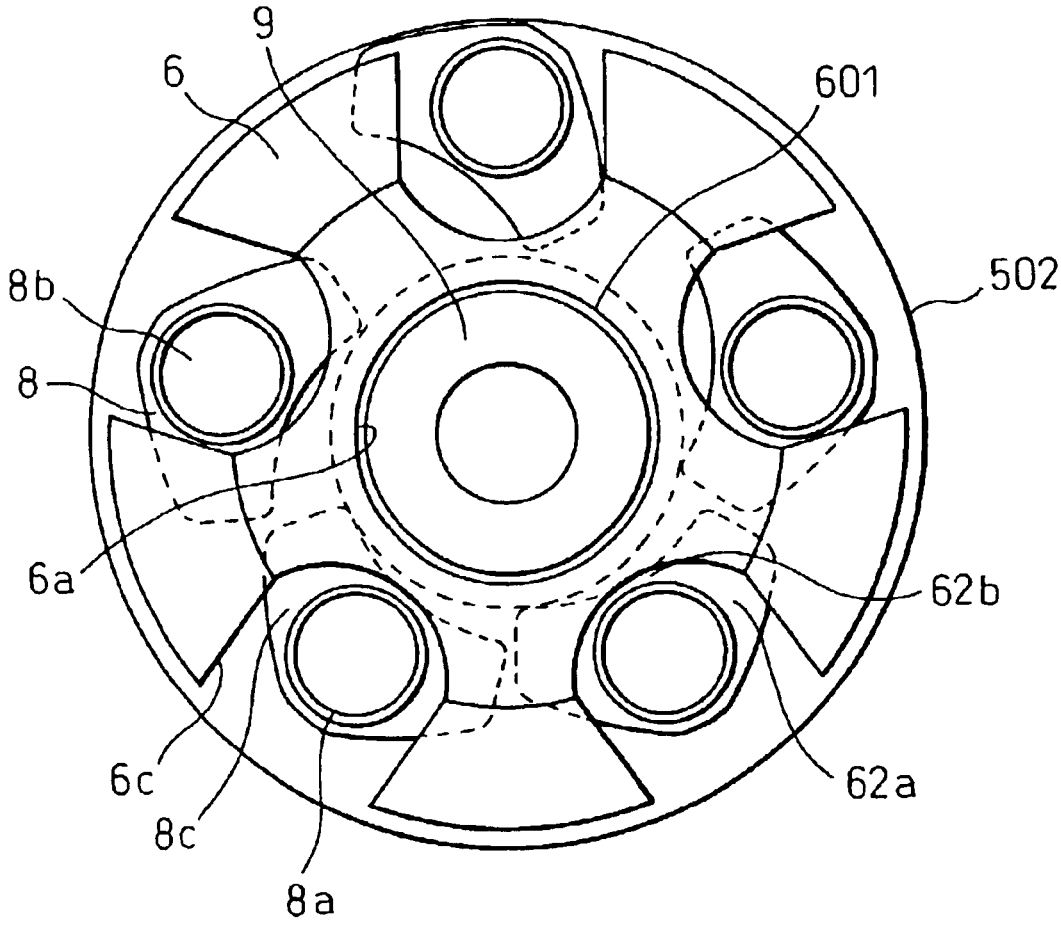
FIG. 28 is a side view of related parts of a shoe holder plate and shoes in a 13th embodiment.

As a modification of the 12th embodiment, FIG. 28 shows a 13th embodiment of the present invention. As will be clear from a comparison with FIG. 27, the shape of the shoe flange 8*c* in the 13th embodiment is a shape between the fan shape of the 12th embodiment shown in FIG. 27 and the rectangular shape of the first embodiment shown in FIG. 3. The fact that the projecting portion of the shoe flange 8*c*, however, is made as large as possible within a range not causing interference with an adjoining shoe flange 8*c* so as to enlarge the sliding contact area with the shoe holding plate 6 or ring-shaped plate 502 is the same. By just making the shoe flange 8*c* larger to this extent, far better results are obtained compared with the conventional circular shoe.

Figure 29:
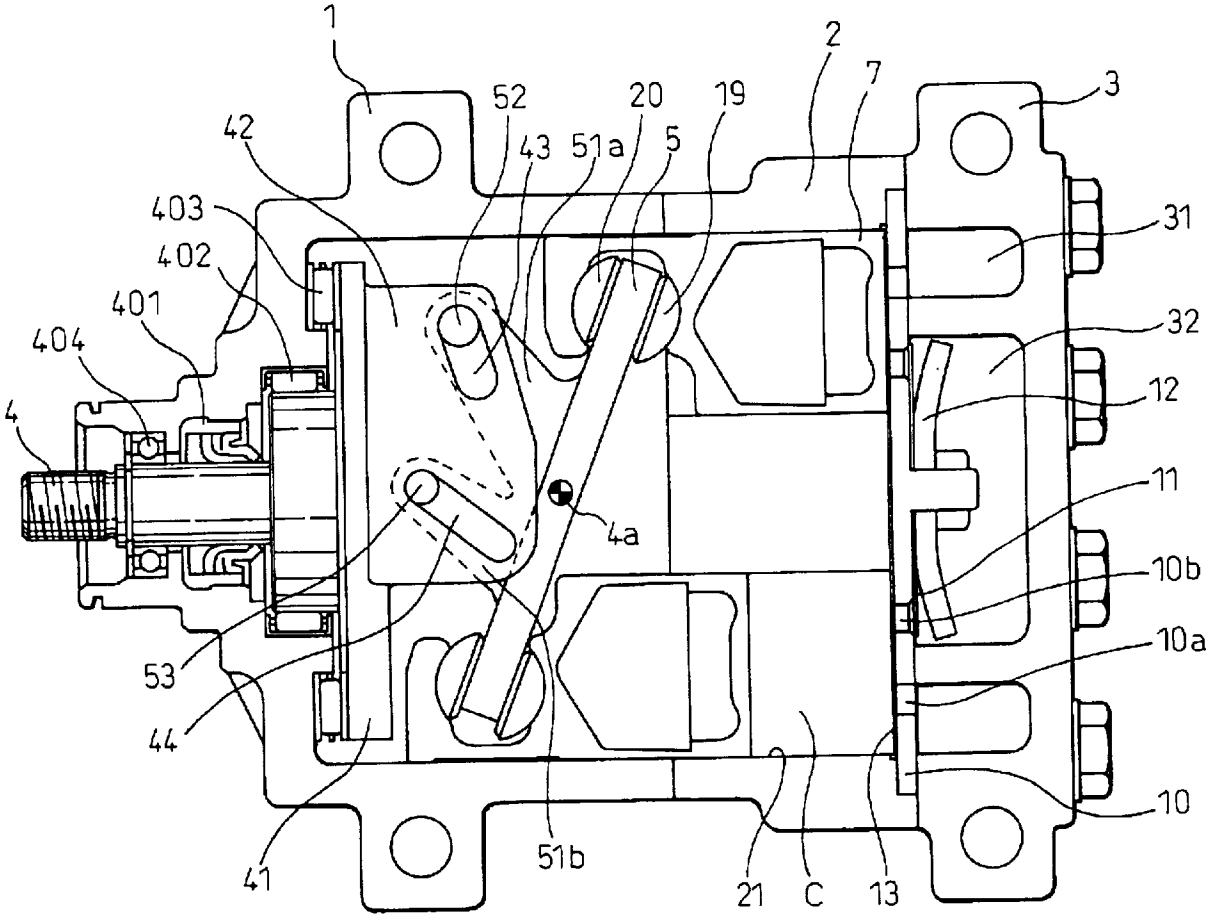
FIG. 29 is a longitudinal sectional front view of a 14th embodiment of a compressor of the present invention.
Figure 30:
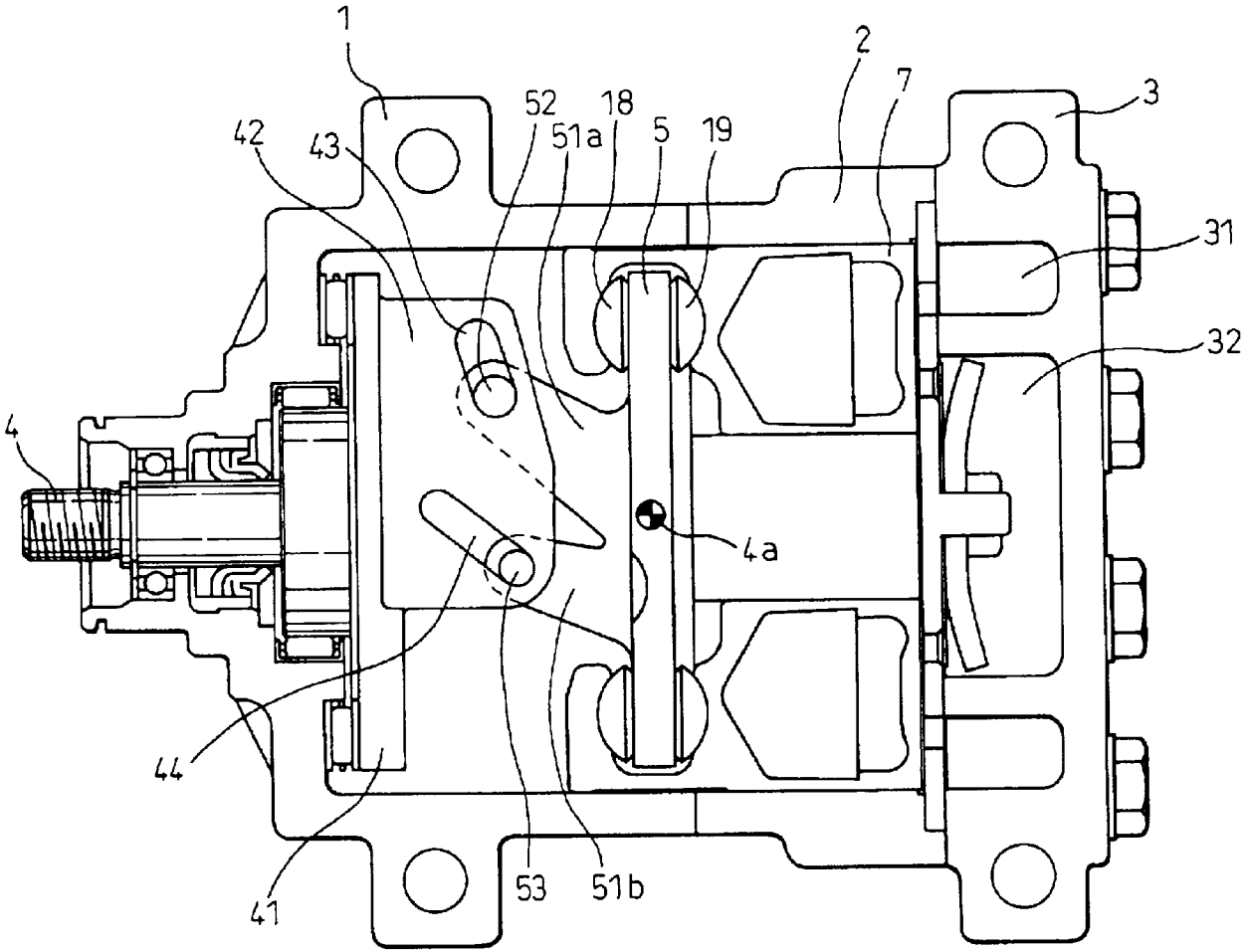
FIG. 30 is a longitudinal sectional front view of another operating state of the embodiment shown in FIG. 29.
Figure 31:
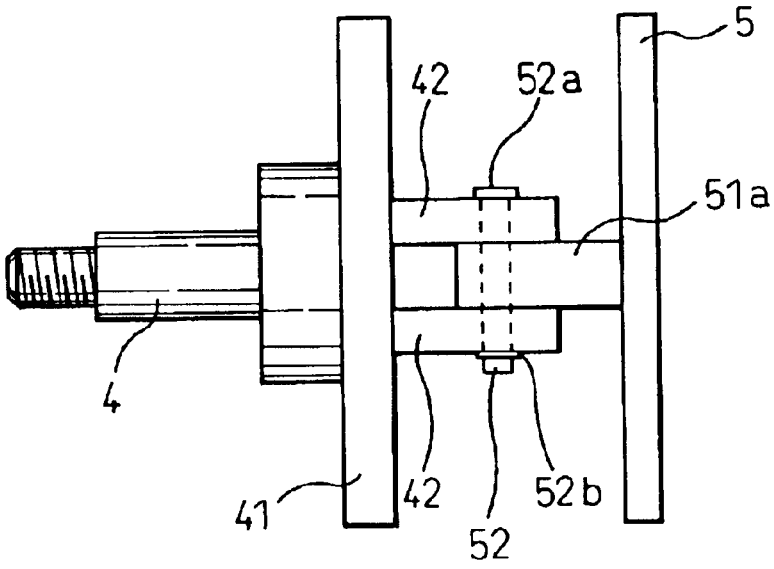
FIG. 31 is a plan view showing key parts of the embodiment shown in FIG. 29.

Next, FIG. 29 to FIG. 31 will be used to explain a 14th embodiment of the variable capacity compressor of the present invention. The main point of difference between the variable capacity compressor of the 14th embodiment and the first embodiment shown in FIG. 1 and FIG. 2 is that, in the first embodiment, the shoe 8 of each piston 7 indirectly engages with the drive plate 5 through the drive thrust bearing 500, while, in the 14th embodiment, as frequently practiced in conventional drive plate type variable capacity compressors, a pair of semispherical shoes 19 and 20 provided at the piston 7 engage directly slidably so as to sandwich the drive plate 5 between them. Therefore, there is no need to provide the drive thrust bearing 500 or the shoe holding plate 6, holding plate thrust bearing 601, etc. of the first embodiment. With the exception of the point that the pair of shoes 19 and 20 directly slidingly engage with the drive plate 5, the variable capacity compressor of the 14th embodiment has substantially the same configuration as that of the first embodiment.

The variable capacity compressor of the 14th embodiment is not suitable for high speed, high load operation since the shoes 19 and 20 and the drive plate 5 slide with each other at a high speed, but with the exception of the engagement parts of the drive plate 5 and shoes 8, the rest of the configuration is similar to that of the first embodiment, so due to the drive plate 5 being supported by the shaft 4 in a cantilever fashion through the double slide link mechanism, substantially the same actions and effects are exhibited as in the first embodiment etc. Therefore, the 14th embodiment illustrates that the technical idea of the present invention can be applied to a variable capacity compressor using conventional types of shoes 19 and 20.

Looking at the detailed structure in the 14th embodiment, the arm 51 provided at the drive plate 5 is branched into the top arm 51*a* and the bottom arm 51*b* in the 14th embodiment in the same way as the seventh embodiment shown in FIG. 10 etc. These are formed by a single plate as shown in FIG. 31. Therefore, the two arms 42 supporting the top pin 52 attached to the top arm 51*a* (in FIG. 31, a head being indicated by 52*a* and a locking snap ring by 52*b*) by the top guide groove 43 and supporting the bottom pin 53 attached to the bottom arms 51*b* by the bottom guide groove 44 support the top arm 51*a* and bottom arm 51*b*, made from a single sheet, by gripping them from the two sides.

Figure 32:
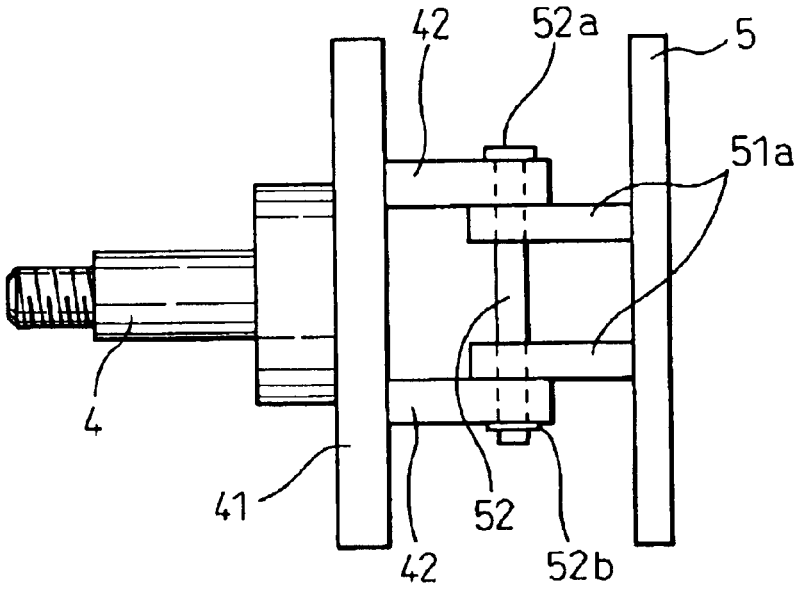
FIG. 32 is a plan view showing key parts of a 15th embodiment of the present invention.

Key parts of the 15th embodiment are shown in FIG. 32 as a modification of the 14th embodiment. The point of difference of the 15th embodiment from the 14th embodiment lies in the fact that two top arms 51*a* (and therefore also the bottom arms 51*b* shown in FIG. 29) are provided at a predetermined interval and the two arms 42 support the arms 51*a*, 51*b* through the pin 52 from the outside. By making the interval between the two arms 42 sufficiently large, there is the advantage that the state of the drive plate 5 being supported by the shaft 4 becomes more stable than in the 14th embodiment.

Note that in the illustrated embodiment, the present invention is explained as being related to a variable capacity type of compressor, but if considering the fact that a fixed capacity type compressor where the tilt angle of the drive plate 5 is fixed is a special mode of a variable capacity type of compressor, it is clear that some of the parts characterizing the present invention can also be applied to a fixed capacity type of compressor, so in that sense the present invention also covers a fixed capacity type compressor. Further, even when applying the present invention to a fixed capacity type compressor, the effects of the present invention explained above such as the ability to make the compressor more compact and streamlined are of course obtained.

Figure 33:
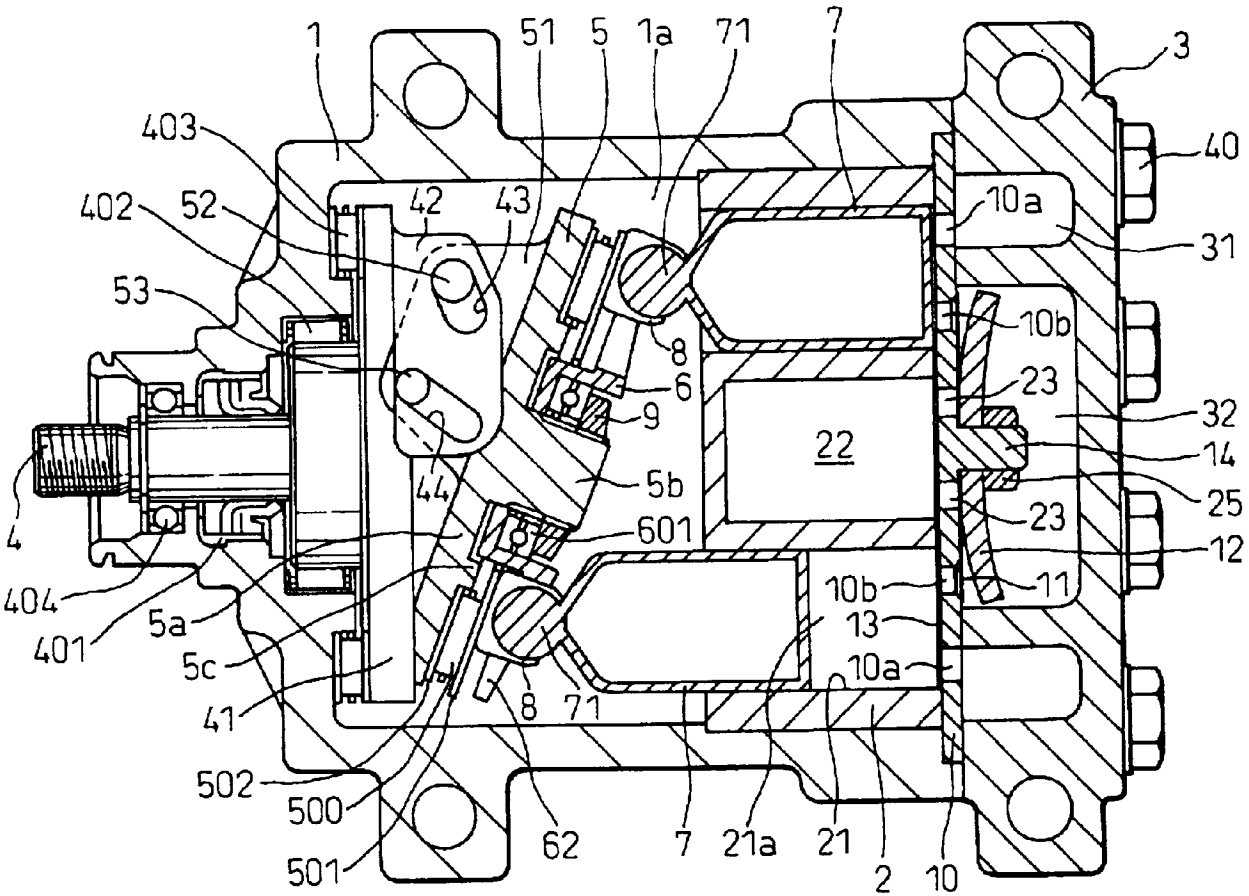
FIG. 33 is a longitudinal sectional front view of a drive plate type variable capacity compressor according to a 16th embodiment of the present invention.
Figure 34:
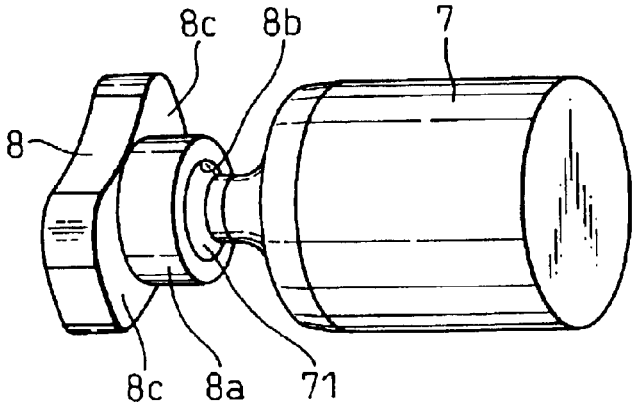
FIG. 34 is a perspective view of an outer shape of a shoe and an engagement part with the piston.
Figure 35:
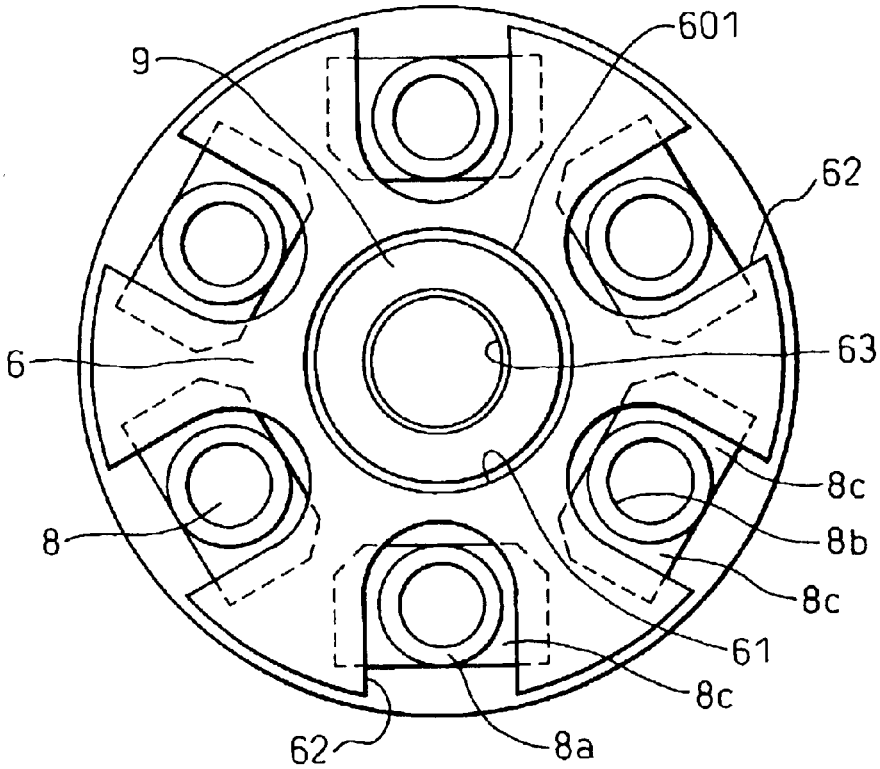
FIG. 35 is a side view illustrating related parts of a shoe holding plate and shoes.

Among the attached figures, FIG. 33 to FIG. 35 show a 16th embodiment of the case of working the present invention as a drive plate type variable capacity compressor. In FIG. 33, showing the longitudinal sectional structure of the compressor as a whole in an operating state giving the maximum discharge capacity, reference numeral 1 is a front housing constituting part of a shell of the compressor, while 2 is a cylinder block which is inserted into the front housing 1 and is joined with a rear housing 3 by a plurality of through bolts 40. At the inside of the cylinder block 2, five or six cylinder bores 21 are formed extending in the lateral direction in FIG. 33 (axial direction) generally equidistantly around a center axis. At the outer periphery at the inside of the rear housing 3 is formed a suction chamber 31 forming an open space. At the center is formed a discharge chamber 32 forming an open space.

Reference numeral 4 is a shaft for receiving rotational power from an external power source. A disk part 41 is formed integrally perpendicular to the same. A single arm 42 is provided to stick out generally in the axial direction from part of the outer periphery of the disk part 41. At the arm 42 are formed two guide grooves serving as cams, that is, a top guide groove 43 and a bottom guide groove 44, in predetermined shapes at predetermined positions at the top and bottom. The shaft 4 is axially supported by the front housing 1 through radial bearings 402 and 404 and is axially supported by the front housing 1 in the axial direction as well through a thrust bearing 403 supporting the back surface of the disk part 41. Note that shaft sealing devices 401 are provided at these bearing parts to prevent fluid from leaking from around the shaft 4 to the outside.

Reference numeral 5 is a drive plate comprised of a generally disk shaped disk part 5*a*, a shaft part 5*b* formed so as to project from its center, a rim part 5*c* projecting in a ring shape from the disk part 5*a* around the shaft part 5*b*, etc. The drive plate 5 is provided with two arms 51 projecting from its back surface toward the disk part 41 and supports two pins 52 and 53 between the two arms 51. These pins 52 and 53 are inserted into the top guide groove 43 and bottom guide groove 44 formed in the above-mentioned arm 42 at the shaft 4 side to be slidably engaged with the same. Due to this, the drive plate 5 can rotate together with the shaft 4 and can tilt with respect to the shaft 4.

The shaft part 5*b* of the drive plate 5 has fit over it a shoe holding plate 6 having an opening at its center. This is rotatably connected with the drive plate 5 by a holding plate thrust bearing 601 and holding nut 9. The shoe holding plate 6 is used to grip the later-explained shoes 8 and drive thrust bearing 500 with the drive plate 5. Note that the shaft part 5*b* of the drive plate 5 is provided with a male thread for screwing into the holding nut 9.

In the 16th embodiment, the specific shape of the shoe 8 rotatably engaging with the spherical end 71 at one end of each piston 7 so as to form a ball joint together with the spherical end 71 will be clear if viewing the perspective view of FIG. 34. Further, the specific shape of the shoe holding plate 6 will be clear if viewing FIG. 35 in addition to FIG. 33. However, this example shows the case of six pistons 7. The shoe holding plate 6 is provided with a circular depression 61 at the center and can house the holding plate thrust bearing 601 in that depression 61. At the center of the depression 61, as mentioned above, is formed an opening 63 for engaging with the shaft part 5*b* of the drive plate 5. At the periphery of the shoe holding plate 6 are radially formed the exact same number of fixed width shoe guide grooves 62 as the number of pistons 7.

The shoe guide groove 62 has slidably engaged with it a shoe body 8*a* of a shape close to a closed bottom cylinder of a shoe 8 of the shape shown in FIG. 34. The shoe holding plate 6 is connected rotatably relative to the drive plate 5, but since the shoe bodies 8*a* attached to the pistons 7 are engaged with the shoe guide grooves 62 of the shoe holding plate 6, rotation of the shoe holding plate 6 is prevented and only rocking motion is performed along with tilted rotary motion of the drive plate 5. Along with this, some changes occur in the distances among the plurality of shoe bodies 8 on the shoe holding plate 6 and their positions. Therefore, the width and other dimensions of the shoe guide grooves 62 of the shoe holding plate 6 are set with some margin.

The shoe body 8*a* of each shoe 8 is formed with a spherical depression 8*b*. A spherical end 71 formed at one end of each piston 7 is press-fit into this and locked by calking or another method to form a ball joint enabling it to engage with the shoe 8 in a rotatable and slidable manner. The piston 7 to which the shoe 8 is attached is inserted slidably in a cylinder bore 21 of the cylinder block 2. Further, each shoe 8 is formed with a pair of shoe flanges 8*c* projecting out from the shoe body 8*a*. Each shoe flange 8*c* is pressed by the two side portions of a shoe guide groove 62 formed in the shoe holding plate 6.

The holding nut 9 screwed over the male thread formed at the shaft part 5*b* of the drive plate 5 presses the shoe holding plate 6 toward the drive thrust bearing 500 and drive plate 5 through the holding plate thrust bearing 601. Due to this, the shoe holding plate 6 can simultaneously press the plurality of shoes 8 on to the drive thrust bearing 500. In this way, the thrust bearing 500, the plurality of shoes 8, the shoe holding plate 6, and the holding plate thrust bearing 601 are assembled on the drive plate 5. The rim part 5*c* of the drive plate 5 is useful for positioning the bearing 500 with respect to the disk part 5*a*. Note that reference numerals 501 and 502 shown in FIG. 33 are ring-shaped plates forming part of the drive thrust bearing 500.

Reference numeral 10 is a valve port plate comprised of a thick plate having at least one each of a suction port 10*a* and discharge port 10*b* passing through the same at positions corresponding to each cylinder bore 21. Each suction port 10*a* can communicate a working chamber 21*a* in a cylinder bore 21 and a suction chamber 31 formed at the outer periphery in the rear housing 3. Similarly, each discharge port 10*b* can communicate a working chamber 21*a* and a discharge chamber 32 formed in the center in the rear housing 3.

Each suction port 10*a* of the valve port plate 10 is closed off from the cylinder bore 21 side by part of a suction valve 13 made of a single thin sheet of spring steel. Each discharge port 10*b* is closed off from the discharge chamber 32 side by part of a discharge valve 11 again made of a single thin sheet of spring steel. The discharge valve 11 is simultaneously fastened when a valve holder 12 protecting it is screwed to a valve port plate 10 by a bolt 14 and nut 25. Further, the valve port plate 10 and suction valve 13 are fastened by being gripped between the front housing 1 and cylinder block 2 and the rear housing 3 when these are fastened together as a whole.

As explained above, the cylinder block 2 is formed with five, or as shown in the example of FIG. 35, six, cylinder bores 21, but a considerably large dead space is formed at its center. This is because the shaft 4 is supported by only the front housing 1, the front end of the shaft 4 does not extend to the cylinder block 2, and no bearing for supporting the front end is provided either. In the 16th embodiment, this dead space is utilized to form a muffler chamber 22 forming an open space. This muffler chamber 22 is communicated with the discharge chamber 32 through at least one communication port 23 formed through the valve port plate 10. Note that while not shown, as other embodiments, it is also possible to make the muffler chamber 22 communicate with the suction chamber 31 or divide the muffler chamber 22 into two parts and make one part communicate with the discharge chamber 32 and the other part with the suction chamber 31.

Figure 36:
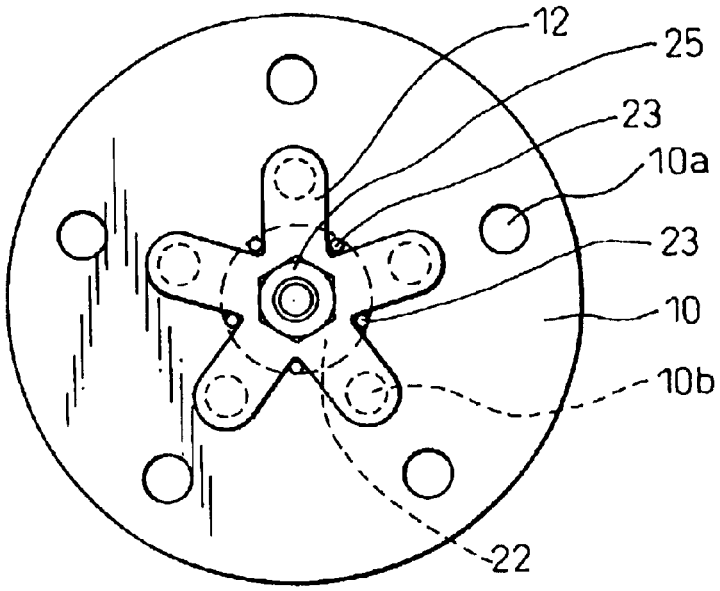
FIG. 36 is a side view of a first example of arrangement of ports communicating with a muffler chamber.
Figure 37:
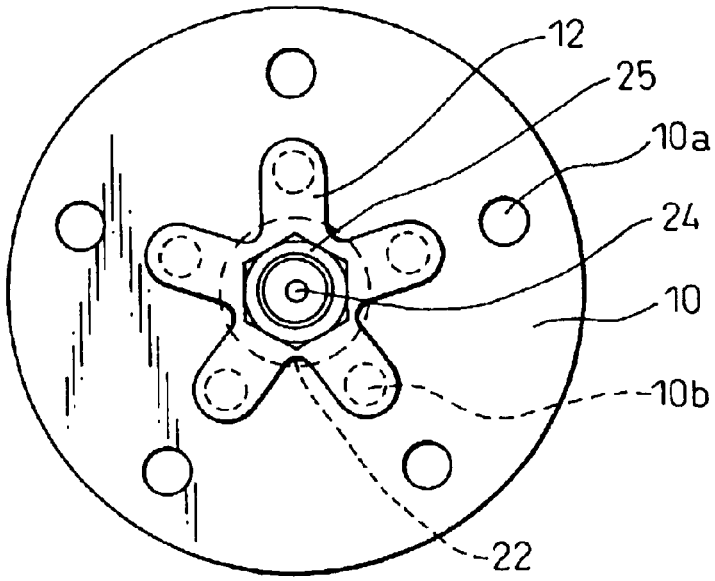
FIG. 37 is a side view of a second example of arrangement of a port communicating with a muffler chamber.

Specific examples of the arrangement of the communication ports 23 are shown in FIG. 36 and FIG. 37. In both cases, five cylinder bores 21 are formed in the cylinder block 2 and five pistons 7 are used. In the first example of arrangement shown in FIG. 36, five communication ports 23 are formed at branching parts of the star-shaped valve holder 12. These are also the branching parts of the similarly shaped discharge valve 11 hidden behind the valve holder 12. In the second example of arrangement shown in FIG. 37, a single communication port 24 is formed passing through the center of the bolt 14.

Next, the operation of the drive plate type variable capacity compressor of a 16th embodiment of the present invention will be explained. When the shaft 4 is driven to rotate by an external power source such as an internal combustion engine or motor mounted in a vehicle, the drive plate 5 connected to the disk part 41 of the shaft 4 through the arm 42, the top and bottom guide grooves 43 and 44, the two pins 52 and 53, and the two arms 51 rotates integrally with the shaft 4. The shoe holding plate 6 is supported with respect to the drive plate 5 through the holding plate thrust bearing 601, and the plurality of shoes 8 engaged with the shoe guide grooves 62 are engaged with the spherical ends 71 of the pistons 7, so do not rotate. Only when the drive plate 5 is tilted as shown in FIG. 33 with respect to the imaginary plane perpendicularly intersecting the shaft 4, the shoe holding plate 6 engages in rocking motion of a magnitude corresponding to the tilt angle while gripping the drive thrust bearing 500 and the plurality of shoes 8 with the drive plate 5. Due to this, the plurality of shoes 8 gripped between the shoe holding plate 6 and the drive plate 5 through the drive thrust bearing 500 and the plurality of pistons 7 connected with the same engage in reciprocating motion in the cylinder bores 21.

In the case of the 16th embodiment, the drive plate 5 and the shoe holding plate 6 change in tilt angle with respect to the shaft 4 when the two pins 52 and 53 move by sliding in the shaft 4 side top guide groove 43 and bottom guide groove 44, so the strokes of all of the pistons 7 change simultaneously by exactly the same amounts. Due to this, the discharge capacity of the compressor changes smoothly.

The working chambers 21*a* formed in the top faces of the plurality of pistons expand and become low in pressure when in the suction stroke, so the fluid to be compressed in the suction chamber 31, for example, the refrigerant of an air-conditioning system, pushes open the suction valve 13 provided at the suction ports 10*a* of the valve port plate 10 and flows in. As opposed to this, the working chambers 21*a* formed at the top faces of the pistons in the compression stroke shrink, so the fluid inside them is compressed and becomes high in pressure, pushes open the discharge valve 11 provided at the discharge ports 10*b* of the valve port plate 10, and is discharged to the discharge chamber 32. The discharge capacity in this case is generally proportional to the length of the strokes of the pistons 7 as determined by the tilt angle of the drive plate 5 and the shoe holding plate 6.

If changing the tilt angle of the drive plate 5 and shoe holding plate 6 in this way, the discharge capacity of the compressor changes, so to control the discharge capacity, in the variable discharge type compressor of the 16th embodiment, the pressure in the front housing chamber 1*a* forming the back pressure of all of the pistons 7 is changed using a not shown pressure control valve etc. Normally, a pressure between the high pressure in the discharge chamber 32 and the low pressure in the suction chamber 31 is introduced into the front housing chamber 1*a* as control pressure from the pressure control valve.

If the pressure inside the front housing chamber 1*a*, that is, the back pressure of all of the pistons 7, is raised, the state of balance between the back pressure and the pressure in the working chambers 21*a* formed in the top faces of the pistons 7 is lost, so until a new state of balance is obtained, the average positions of the plurality of pistons 7 move toward positions close to the valve port plate 10. Due to this, the strokes of all of the pistons 7 become smaller all at once, so the discharge capacity of the compressor is reduced smoothly.

While not shown, when the pressure in the front housing chamber 1*a* becomes the greatest and the tilt angle of the drive plate 5 and the shoe holding plate 6 becomes substantially zero, all of the pistons 7 are substantially at the top dead center positions and do not engage in almost any reciprocating motion in the cylinder bores 21 at all.

As opposed to this, when the not shown pressure control valve is operated to lower the pressure in the front housing chamber 1*a*, the back pressure acting on the pistons 7 becomes smaller, so the strokes of all of the pistons 7 become larger all together and the discharge capacity of the compressor becomes smoothly larger. FIG. 33 shows the state where the pressure in the front housing chamber 1*a* becomes the smallest, the tilt angle of the drive plate 5 and the shoe holding plate 6 becomes greater to the maximum extent, and the strokes of the pistons 7 and the discharge capacity of the compressor become maximum.

One characterizing feature of the 16th embodiment is the point that the plurality of shoes 8 engaged directly with the spherical ends 71 of the pistons 7 are supported gripped by a single shoe holding plate 6 with the drive plate 5 through a drive thrust bearing 500 and the drive plate 5 is connected to the shaft 4 side arm 42 using a double slide link mechanism comprised of two guide grooves 43 and 44 and two pins 52 and 53 so as to support all of the parts relating to the drive plate 5 by just the front housing 1 through the radial bearings 402 and 404 and the thrust bearing 403.

Figure 38:
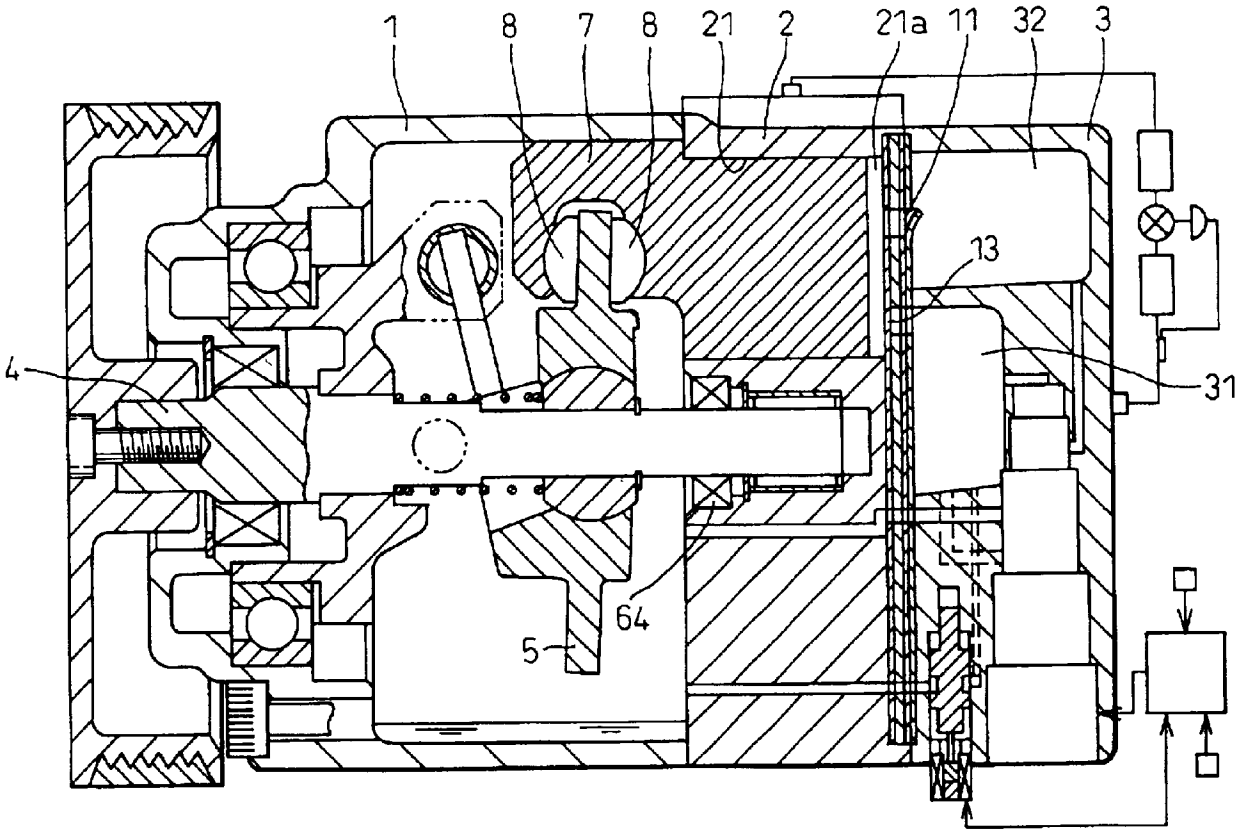
Fig.38 PRIOR ART
FIG. 38 is a longitudinal sectional front view of a related art.

Due to this, there is no longer a need to extend the front end of the shaft 4 to reach the cylinder block 2 and support it by a bearing 64 as in the conventional compressor shown in FIG. 38, so in the 16th embodiment, a muffler chamber 22 forming an open space of a size just large enough to enable use of the dead space formed at the center of the cylinder block 2 is formed and this muffler chamber 22 is communicated with the discharge chamber 32 by five communication ports 23 formed in the valve port plate 10. This is the second characterizing feature.

By the communication between the discharge chamber 32 and the muffler chamber 22, the apparent volume of the discharge chamber 32 increases remarkably, so pressure fluctuations (discharge pulsation) of the compressed fluid sent from the discharge chamber 32 to the outside are effectively suppressed. Further, in the 16th embodiment, the muffler chamber 22 is communicated with the discharge chamber 32, but when communicating the muffler chamber 22 with the suction chamber 31 by not shown communication ports, the suction pulsation is of course suppressed. Further, as explained above, if splitting the muffler chamber 22 into two and communicating it with both the suction chamber 31 and discharge chamber 32, it is possible to simultaneously suppress the suction pulsation and discharge pulsation.

Note that as an additional effect of the present invention, since the shaft 4 is supported only by the front housing 1, compared with the case where the shaft 4 is passed through the center of the drive plate 5 and the front end is supported by the bearing 64 at the center of the cylinder block 2, not only is the configuration simpler, but also the length of the shaft 4 is remarkably shortened, so the axial direction length of the compressor as a whole can also be shortened. Further, since it becomes possible to use a small diameter holding plate thrust bearing 601 for connecting the drive plate 5 and shoe holding plate 6, it becomes possible to reduce the girth of the front housing 1 or cylinder block 2 in the radial direction as well. The is useful for reducing the size and lowering the weight of the compressor as a whole and streamlining the configuration, so contributes greatly to the reduction of the manufacturing costs.

Further, the 16th embodiment relates to a variable capacity type compressor, but can clearly also be applied to a fixed capacity type compressor. Further, the present invention is not limited to just drive plate type compressors.

Figure 39:
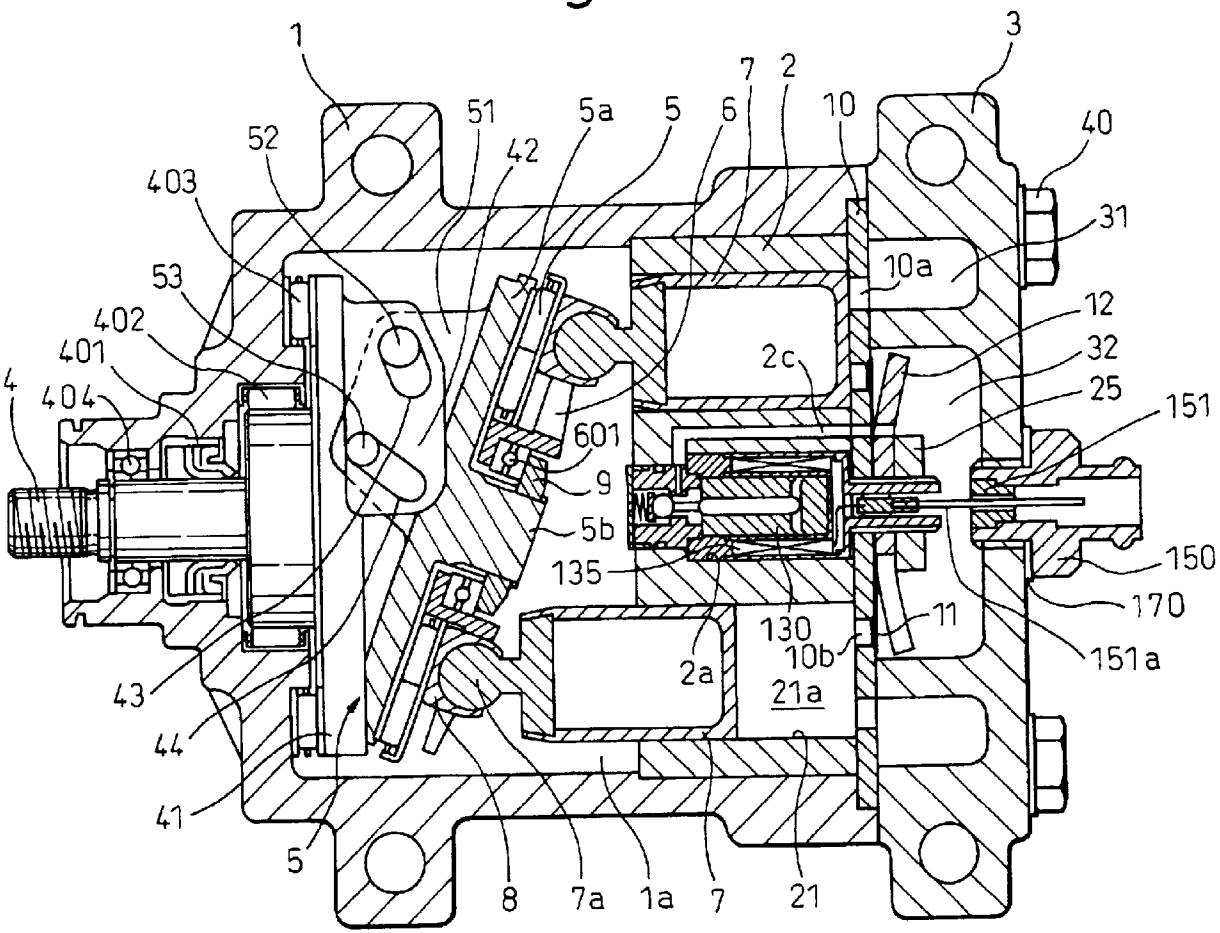
FIG. 39 is a longitudinal sectional view of a first embodiment of the compressor of the present invention.
Figure 40:
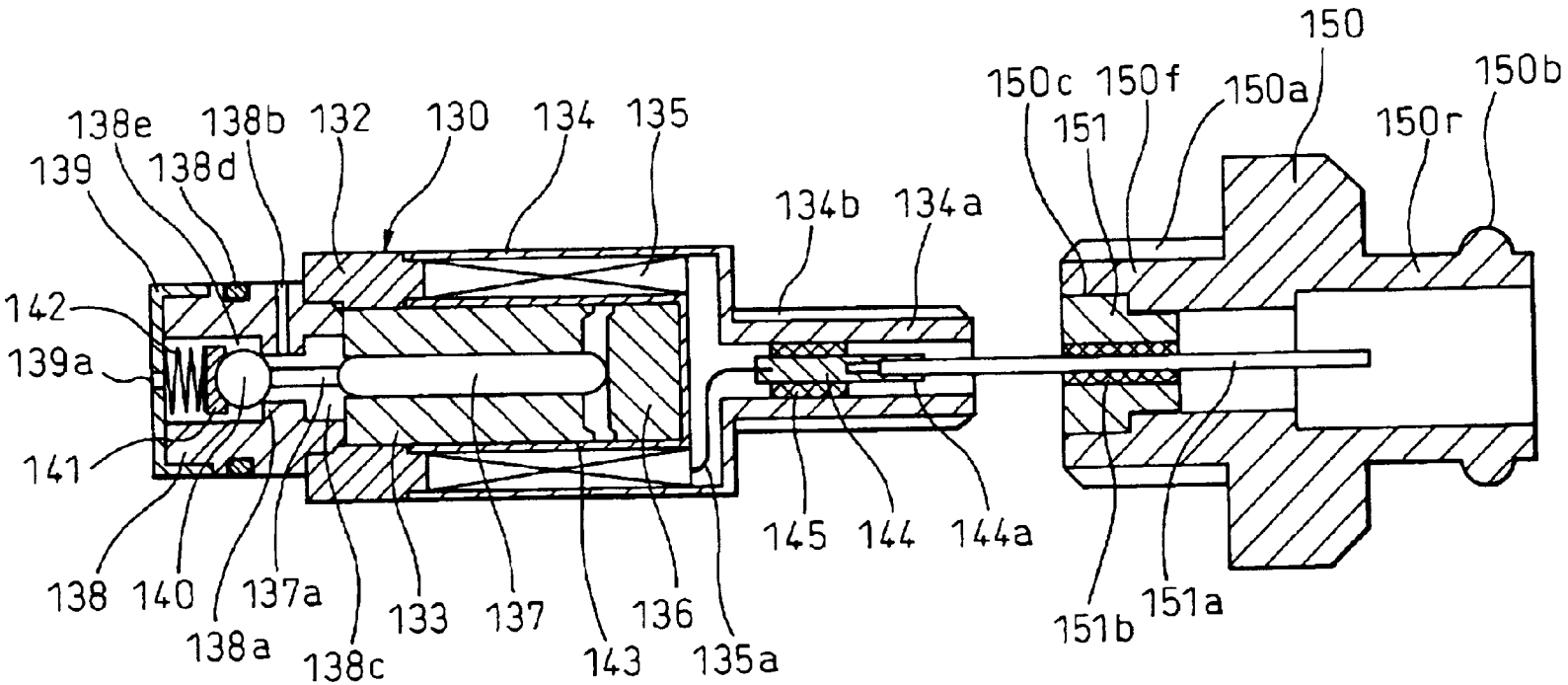
FIG. 40 is a longitudinal sectional view of a first embodiment of a capacity control valve and its related parts.
Figure 41:
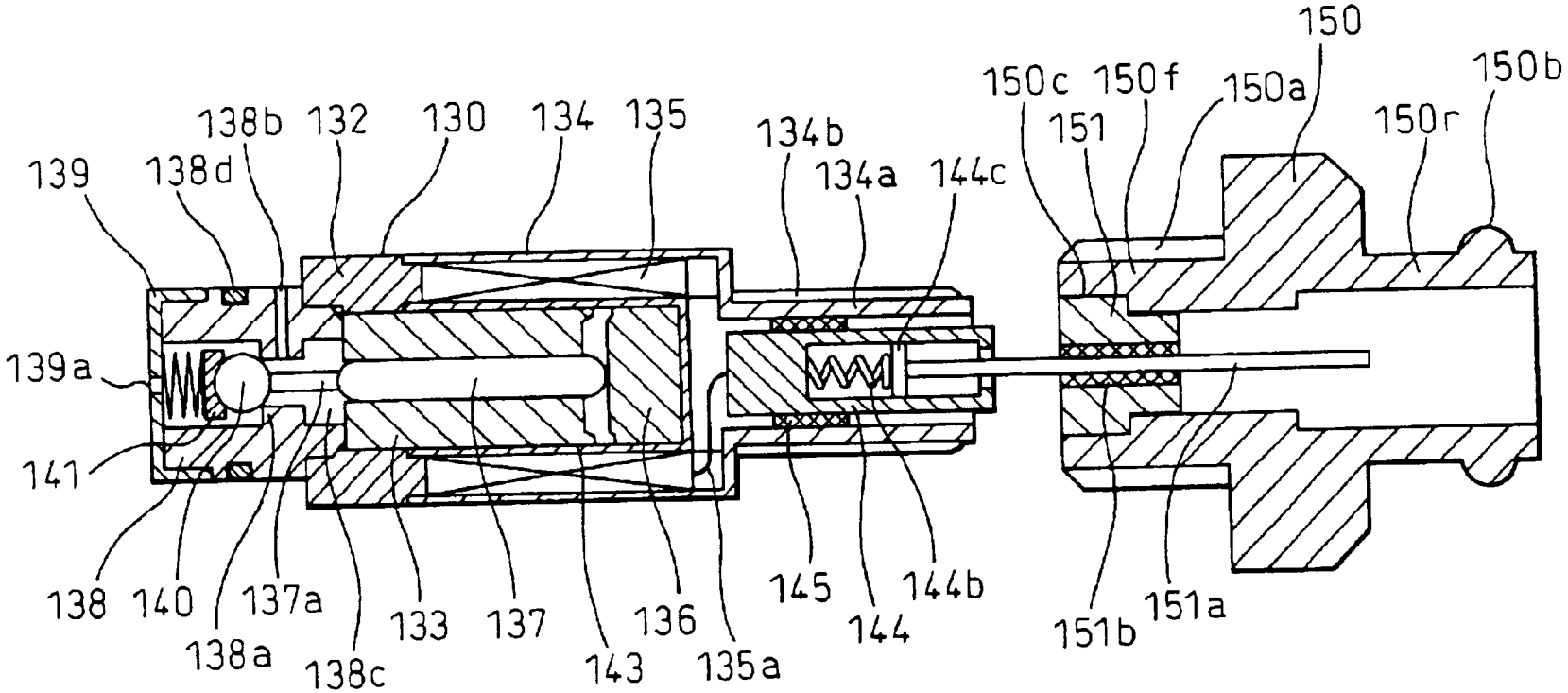
FIG. 41 is a longitudinal sectional view of a second embodiment of a capacity control valve and its related parts.

FIG. 39 shows a 17th embodiment of the case of working the present invention in a drive plate type variable capacity compressor. Two partial examples of just the key parts of the capacity control valve and the terminals attached to the same are shown in FIG. 40 and FIG. 41. In FIG. 39, showing the longitudinal sectional structure of the compressor as a whole in an operating state giving the maximum discharge capacity for the compressor of the 17th embodiment, reference numeral 1 is a front housing constituting part of a shell of the compressor, while 2 is a cylinder block which is inserted into the front housing 1 and is joined with a rear housing 3 by a plurality of through bolts 40. At the inside of the cylinder block 2, five or six cylinder bores 21 are formed extending in the lateral direction in FIG. 39 ("axial direction") generally equidistantly around a center axis. At the outer periphery at the inside of the rear housing 3 is formed a suction chamber 31 forming an open space. At the center is formed a discharge chamber 32 forming an open space.

Reference numeral 4 is a shaft for receiving rotational power from an external power source. A disk part 41 is formed integrally perpendicular to the same. A single arm 42 is provided to stick out in the axial direction from part of the outer circumference of the disk part 41. At the arm 42 are formed two guide grooves serving as cams, that is, a top guide groove 43 and a bottom guide groove 44, in predetermined shapes at predetermined positions at the top and bottom. The shaft 4 is axially supported by the front housing 1 through radial bearings 402 and 404 and is axially supported by the front housing 1 in the axial direction as well through a thrust bearing 403 supporting the back surface of the disk part 41. Note that shaft sealing devices 401 are provided at these bearing parts to prevent fluid from leaking from around the shaft 4 to the outside.

Reference numeral 5 is a drive plate comprised of a generally disk-shaped disk part 5*a*, a shaft part 5*b* formed so as to project from its center, etc. The drive plate 5 is provided with two arms 51 projecting from its back surface toward the disk part 41 and supports two pins 52 and 53 between the two arms 51. These pins 52 and 53 are inserted into the top guide groove 43 and bottom guide groove 44 formed in the above-mentioned arm 42 at the shaft 4 side to be slidably engaged with the same. Due to this, the drive plate 5 can rotate together with the shaft 4 and can tilt with respect to the shaft 4.

The shaft part 5*b* of the drive plate 5 has fit over it a shoe holding plate 6 having an opening at its center. This is rotatably connected with the drive plate 5 by a holding plate thrust bearing 601 and holding nut 9. The shoe holding plate 6 is used to grip the later-explained shoes 8 and drive thrust bearing 500 with the drive plate 5. Note that the shaft part 5*b* of the drive plate 5 is provided with a male thread for screwing into the holding nut 9.

To form a ball joint together with the spherical end 7*a* of each piston 7 in the 17th embodiment, a shoe rotatably engaging with the spherical end 7*a* is pushed on the drive thrust bearing 500 by the shoe holding plate 6. The shoe holding plate 6 is provided with a circular depression at the center and can house the holding plate thrust bearing 601 in it. At the periphery of the shoe holding plate 6 are radially formed the exact same number of shoe guide grooves of constant widths as the number of shoes 8, that is, the number of pistons 7. The shoe holding plate 6 is connected rotatably relative to the drive plate 5, but the shoes 8 attached to the pistons 7 are engaged with the shoe guide grooves of the shoe holding plate 6, so rotation of the shoe holding plate 6 is prevented and only rocking motion is performed along with tilted rotary motion of the drive plate 5.

Each shoe 8 is formed with a spherical depression into which a spherical end 7*a* formed at one end of a piston 7 is press-fit and locked by calking or another method, whereby the end is engaged with the shoe 8 in a rotatable and slidable manner. The piston 7 to which the shoe 8 is attached is inserted slidably in an above-mentioned cylinder bore 21. While not shown, each shoe 8 is formed with a pair of shoe flanges sticking out from the side surfaces in the lateral direction. These shoe flanges are pushed by the portions of the two sides of the shoe guide grooves formed in the shoe holding plate 6.

The holding nut 9 screwed over the male thread formed at the shaft part 5*b* of the drive plate 5 presses the shoe holding plate 6 toward the drive thrust bearing 500 and drive plate 5 through the holding plate thrust bearing 601. Due to this, the shoe holding plate 6 simultaneously presses the plurality of shoes 8 on to the drive thrust bearing 500. In this way, the thrust bearing 500, the plurality of shoes 8, the shoe holding plate 6, and the holding plate thrust bearing 601 are assembled on the drive plate 5.

Reference numeral 10 is a valve port plate made of thick plate having at least one each of a suction port 10*a* and discharge port 10*b* passing through the same at positions corresponding to each cylinder bore 21. Each suction port 10*a* can communicate the working chamber 21*a* in the cylinder bore 21 with the suction chamber 31 formed at the outer periphery in the rear housing 3. Similarly, each discharge port 10*b* can communicate the working chamber 21*a* with the discharge chamber 32 formed at the center of the rear housing 3.

Each suction port 10*a* of the valve port plate 10 is closed off from the cylinder bore 21 side by part of a suction valve made of a not shown single thin sheet of spring steel. Each discharge port 10*b* is closed off from the discharge chamber 32 side by part of a discharge valve 11 again made of a single thin sheet of spring steel. The discharge valve 11 is simultaneously fastened when a valve holding plate 12 protecting it is screwed to the valve port plate 10 by a nut 25 engaging with the male thread formed at the cylindrical part of the later explained capacity control valve.

As explained above, the cylinder block 2 is formed with five or six cylinder bores 21, but a considerably large dead space is formed at its center. This is because the shaft 4 is supported by only the front housing 1, the front end of the shaft 4 does not extend to the cylinder block 2, and no bearing for supporting the front end is provided either. In the 17th embodiment, this dead space is utilized for placement of the capacity control valve 13. Therefore, a cavity 2*a* is formed as a stepped opening at the center of the cylinder block 2. The capacity control valve 130 is connected to a not shown control device through a terminal 150 attached to the rear housing 3.

Next, a detailed explanation will be given of a first example of a capacity control valve 130 applied to a compressor of the 17th embodiment shown in FIG. 39 while referring to FIG. 40 which is a partial expanded view of the capacity control valve 130 itself and the related terminal 150. The main body of the control valve 130 is comprised of a yoke 132 comprised of a short cylindrically shaped magnetic body, a stator 133 comprised of a cylindrical magnetic body fastened to its inside, a generally cup-shaped valve housing 134 covering the majority of the outer circumference, a cup-shaped guide tube 143 attached around the stator 133, a solenoid coil 135 wound around the guide tube 143 inside the valve housing 134, a plunger 136 comprised of a magnetic body inserted movably inside the guide tube 143, and a rod 137 inserted inside the stator 133 and transmitting displacement of the plunger 136 forward.

A valve head 138 having a stepped hole passing through its center is screwed to the yoke 132 so as to be connected to the front of the stator 133, whereby a valve seat 138*a* is formed at the stepped part of the hole. The narrowed front end of the rod 137, that is, the rod needle part 137*a*, loosely passes through a narrowed hole behind the valve seat 138 of the valve head 138. A pressure introducing hole 138*b* is formed at that portion from the side. Note that the pressure introducing hole 138*b*, as shown in FIG. 39, communicates with the discharge chamber 32 through the communication hole 2*c* formed through the inside of the cylinder block 2 and the communication holes formed in the valve port plate 10 and valve holding plate 12 corresponding to the same, so it is possible to introduce the pressurized fluid in the discharge chamber 32 to the high pressure chamber 138*c* of the control valve 130. Further, an O-ring 138*d* is fit into the ring-shaped groove at the outer circumference of the valve head 138 whereby the space with the cavity 2*a* of the cylinder block 2 is sealed.

A cap 139 is screwed to the front end of the valve head 138, while a valve opening 139*a* is formed at its bottom. The valve chamber 138*e* comprised of the inner space in front of the valve seat 138*a* of the valve head 138 has inserted into it a steel ball 140 opening and closing the valve seat 138*a* as a valve element. This is biased in a direction closing the valve seat 138*a* by the elasticity of the spring 142 through the spring seat 141.

At the bottom of the valve housing 134, as shown in FIG. 39, the control valve 130 is inserted in the cavity 2*a* of the cylinder block 2 and is pushed in by the valve port plate 10, whereby it is attached to the compressor. In that state, a cylindrical part 134*a* passing through the holes of the valve port plate 10 and the valve holding plate 12 and extending toward the rear is formed. A male thread 134*b* is provided at its outer circumference, so by screwing the nut 25 over this, the control valve 130 is fastened to the compressor. At the inside of the cylindrical part 134*a*, a center electrode 144 comprised of a conductor is supported through an insulating collar 145. The center electrode 144 is connected to the solenoid coil 135 through a lead wire 135*a*. Further, at the rear end side of the center electrode 144, a connection part 144*a* forming the receiving part of a counterlock is formed.

A female thread of an opening provided passing through the wall of the rear housing 3 corresponding to the position of the capacity control valve 130 mounted in the cavity 2*a* of the cylinder block 2 of the compressor has screwed into it a male thread 150*a* formed at the outer circumference of the front cylinder 150*f* of the terminal 150 having a hexagonal or other shaped flange. One part of the outer circumference of the rear cylindrical part 150*r* where a not shown power feed connector is attached to the solenoid coil 135 forms a rib 150*b* projecting out in a ring for enhancing the locking and waterproofing effect of the connector.

To close the front opening of the terminal 150, a hermetic seal 151 is used for the connection part 150*c*. The hermetic seal 151 supports an electrode rod 151*a* comprised of a copper wire or other good conductor through a glass sealant 151*b*. Due to this, the high pressure fluid is completely prevented from leaking to the outside through the inside of the terminal 150 from the discharge chamber 32 in the rear housing 3. Further, when screwing the terminal 150 into the opening of the rear housing 3, as shown in FIG. 39, a seal washer 170 is used to prevent the high pressure fluid from leaking from around the terminal 150. Note that when screwing the terminal 150 into the rear housing 3, simultaneously the front end of the electrode rod 151*a* is engaged and electrically connected with the connection part 144*a* formed at the center electrode 144 of the control valve 130.

Next, the operation of the compressor of the 17th embodiment of the present invention and the capacity control valve 130 shown in FIG. 40 built into the same will be explained. When the shaft 4 is driven to rotate by an external power source such as an internal combustion engine or motor mounted in a vehicle, the drive plate 5 connected to the disk part 41 of the shaft 4 through the arm 42, the top and bottom guide grooves 43 and 44, the two pins 52 and 53, and the two arms 51 rotates integrally with the shaft 4. The shoe holding plate 6 is supported with respect to the drive plate 5 through the holding plate thrust bearing 601, and the plurality of shoes 8 engaged with the shoe guide grooves are engaged with the spherical ends 7*a* of the pistons 7, so do not rotate.

Only when the drive plate 5 is tilted as shown in FIG. 39 with respect to the imaginary plane perpendicularly intersecting the shaft 4, the shoe holding plate 6 engages in rocking motion of a magnitude corresponding to the tilt angle while gripping the drive thrust bearing 500 and the plurality of shoes 8 with the drive plate 5. Due to this, the plurality of shoes 8 gripped between the shoe holding plate 6 and the drive plate 5 through the drive thrust bearing 500 and the plurality of pistons 7 connected with the same engage in reciprocating motion in the cylinder bores 21.

In the case of the 17th embodiment, the drive plate 5 and the shoe holding plate 6 change in tilt angle with respect to the shaft 4 when the two pins 52 and 53 move by sliding in the shaft 4 side top guide groove 43 and bottom guide groove 44, so the strokes of all of the pistons 7 change simultaneously by exactly the same amounts. Due to this, the discharge capacity of the compressor changes smoothly.

The working chambers 21*a* formed in the top faces of the plurality of pistons expand and become low in pressure when in the suction stroke, so the fluid to be compressed in the suction chamber 31, for example, the refrigerant of an air-conditioning system, pushes open the suction valve 13 provided at the suction ports 10*a* of the valve port plate 10 and flows in. As opposed to this, the working chambers 21*a* formed at the top faces of the pistons in the compression stroke shrink, so the fluid inside them is compressed and becomes high in pressure, pushes open the discharge valve 11 provided at the discharge ports 10*b* of the valve port plate 10, and is discharged to the discharge chamber 32. The discharge capacity in this case is generally proportional to the length of the strokes of the pistons 7 as determined by the tilt angle of the drive plate 5 and the shoe holding plate 6.

If changing the tilt angle of the drive plate 5 and shoe holding plate 6 in this way, the discharge capacity of the compressor changes, so to control the discharge capacity, the pressure in the front housing chamber 1*a* forming the back pressure of all of the pistons 7 is changed using the capacity control valve 130. That is, in the capacity control valve 130 of the 17th embodiment shown in FIG. 39 and FIG. 40, the high pressure fluid is fed to the high pressure chamber 138*c* from the discharge chamber 32 of the compressor through the communication hole 2*c* and pressure introducing hole 138*b*. When a not shown control device outputs a control signal and thereby the solenoid coil 135 is electrically biased and generates a magnetic flux through the electrode rod 151*a* of the terminal 150 and the center electrode 144 connected to the same, the stator 133 is magnetized, so the stator 133 magnetically attracts the plunger 136. Due to this, the steel ball 140 is pushed via the rod 137, so the valve seat 138*a* is made to open against the bias force of the spring 142.

By the capacity control valve 130 opening, the high pressure fluid of the high pressure chamber 138*c* passes through the valve opening 139*a* and flows into the drive plate chamber 1*a*, so the pressure in the drive plate chamber 1*a* rises. While not shown, the drive plate chamber 1*a* is constantly communicated with the suction chamber 31 through a constricted passage, so the level of the pressure in the drive plate chamber 1*a* is determined by the flow rate of the high pressure fluid fed from the capacity control valve 130. Therefore, the capacity control valve 130 is preferably controlled in duty ratio by the control device. In this way, the not shown control device can adjust the pressure inside the drive plate chamber 1*a* through the capacity control valve 130 to any pressure between the high pressure of the discharge chamber 32 and low pressure of the suction chamber 31.

If the pressure inside the drive plate chamber 1*a*, that is, the back pressure of all of the pistons 7, is raised, the state of balance between the back pressure and the pressure in the working chambers 21*a* formed in the top faces of the pistons 7 is lost, so until a new state of balance is obtained, the average positions of the plurality of pistons 7 move toward positions close to the valve port plate 10. Due to this, the strokes of all of the pistons 7 become smaller all at once, so the discharge capacity of the compressor is reduced smoothly. While not shown, when the pressure in the drive plate chamber 1*a* becomes the greatest and the tilt angle of the drive plate 5 and the shoe holding plate 6 becomes substantially zero, all of the pistons 7 are substantially at the top dead center positions and do not engage in almost any reciprocating motion in the cylinder bores 21 at all.

As opposed to this, when the capacity control valve 130 is operated by the control device to lower the pressure in the drive plate chamber 1*a*, the back pressure acting on the pistons 7 becomes smaller, so the strokes of all of the pistons 7 become larger all together and the discharge capacity of the compressor becomes smoothly larger. FIG. 39 shows the state where the pressure in the drive plate chamber 1*a* becomes the smallest, the tilt angle of the drive plate 5 and the shoe holding plate 6 becomes greater to the maximum extent, and the strokes of the pistons 7 and the discharge capacity of the compressor become maximum.

One characterizing feature of the 17th embodiment lies in the fact that a plurality of shoes 8 directly engaged with the spherical ends of the pistons 7 are gripped and supported by a single shoe holding plate 6 with the drive plate 5 through the drive thrust bearing 500 and the drive plate is connected with the arm 42 on the shaft 4 side using a double slide link mechanism comprised of two guide grooves 43 and 44 and two pins 52 and 53, whereby all of the parts relating to the drive plate 5 are supported only by the front housing 1 through the radial bearings 402 and 404 and the thrust bearing 403.

Figure 44:
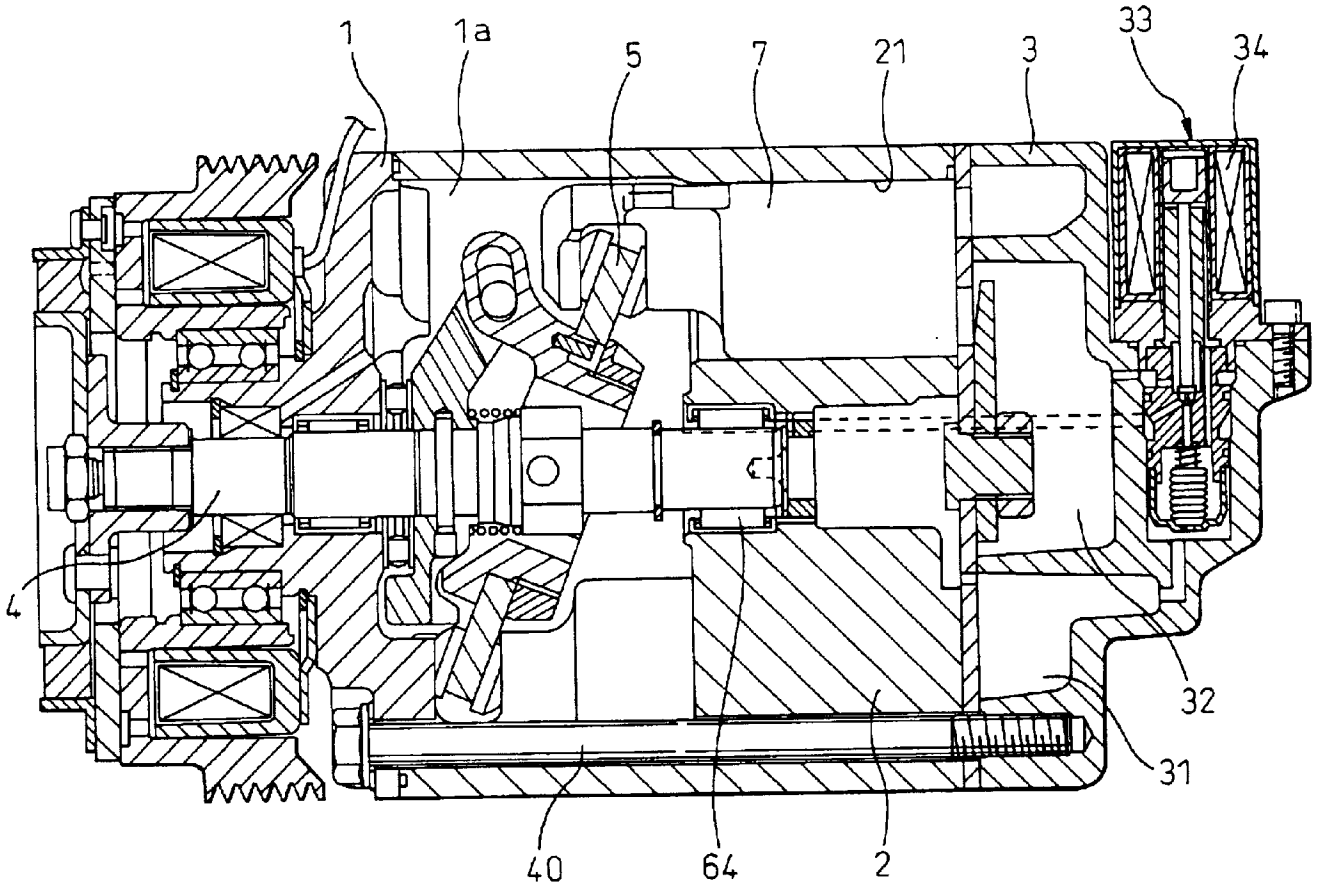
Fig.44 PRIOR ART
FIG. 44 is a longitudinal sectional view of the prior art.

Due to this, there is no longer a need to extend the front end of the shaft 4 to reach the cylinder block 2 and support it by the bearing 64 as in the conventional drive plate type variable capacity compressor shown in FIG. 44, so in the 17th embodiment, a capacity control valve 130 is provided using the dead space formed at the center of the cylinder block 2. This is the second characterizing feature. Due to this, the compressor does not stick out in either the axial direction or radial direction at the portion of the capacity control valve 130, so there is the advantage that the size of the compressor as a whole can be remarkably reduced.

Figure 45:
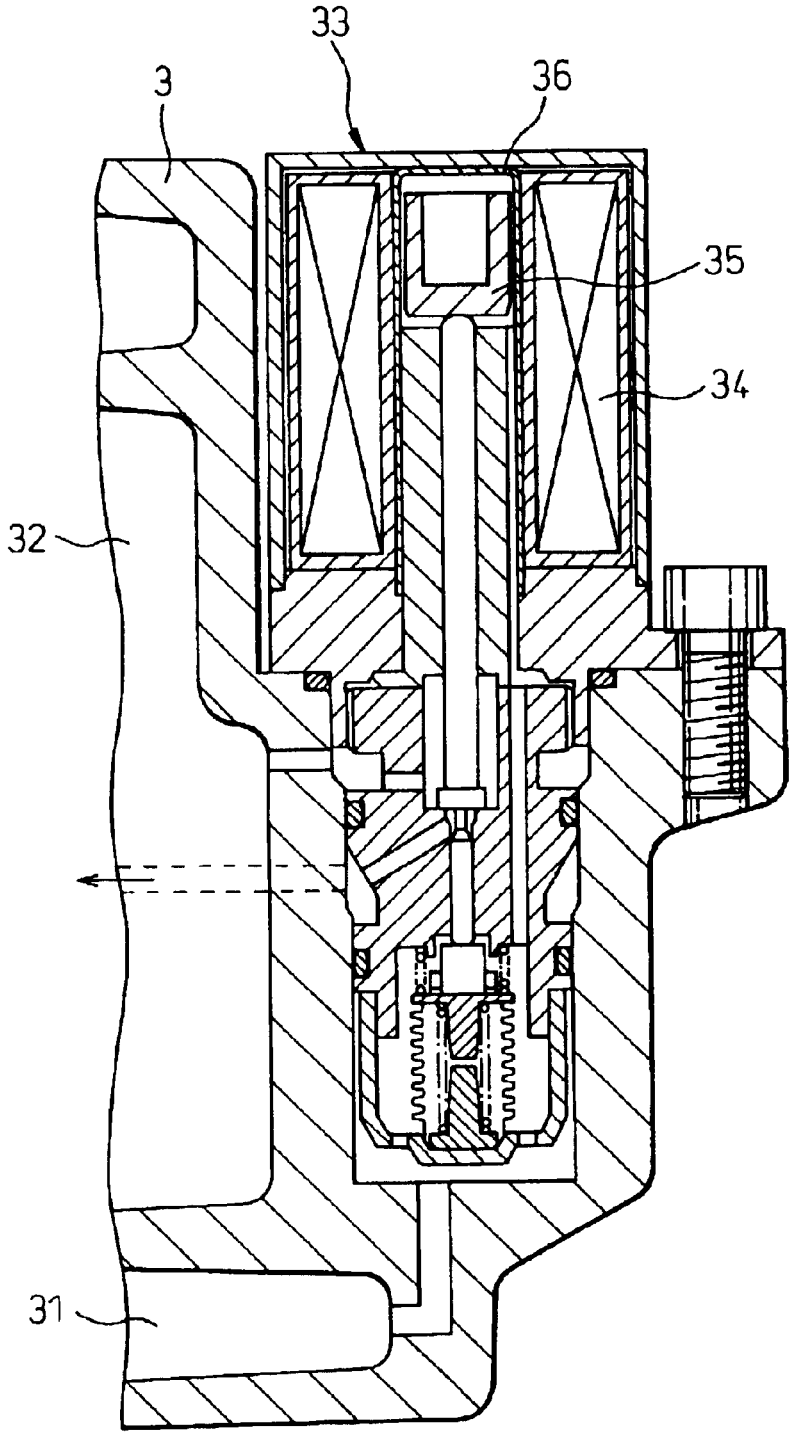
Fig.45 PRIOR ART
FIG. 45 is a longitudinal sectional view showing enlarged a capacity control valve in the prior art of FIG. 44.

Note that as an additional effect, in the 17th embodiment of the compressor of the present invention, since the capacity control valve 130 is provided inside the compressor, there is the advantage that the capacity control valve 130 can be communicated with the discharge chamber 32 etc. by a simple flow path (communication hole 2*c* etc.) Further, if the capacity control valve 130 as a whole is designed to be immersed in a fluid like the refrigerant compressed in the compressor or a lubrication oil such as freezer oil mixed in the same, there is no longer a need for making the tube 36 etc. ones of high hermetic seals to prevent the fluid etc. from penetrating to the solenoid coil 34 as in the prior art shown in FIG. 45. In the capacity control valve in the 17th embodiment, it is sufficient to seal just the takeout opening of the signal line, so it is sufficient to make just the area around the electrode rod 151*a* in the terminal 150 an air-tight structure using a hermetic seal 151 etc.

The guide tube 143 used can be a highly magnetic permeability one even without air-tightness or a thin one. Therefore, if for example using a guide tube 143 provided with a plurality of slits in the longitudinal direction, the magnetic flux generated at the solenoid coil 135 will act efficiently on the plunger 136. Therefore, it is possible to make the structure of the capacity control valve 130 simple and high in magnetic efficiency.

Further, since the shaft 4 is supported by only the front housing 1, compared with the case of passing the shaft 4 through the center of the drive plate 5 and supporting its front end by a bearing 64 at the center of the cylinder block 2 as in the prior art, not only does the configuration become simpler, but also the length of the shaft 4 can be remarkably shortened, so the axial direction length of the compressor as a whole can be shortened. Further, it becomes possible to use a small-diameter holding plate thrust bearing 601 for connecting the drive plate 5 and the shoe holding plate 6 etc., so in the radial direction as well, it becomes possible to make the girth of the front housing 1 or cylinder block 2 smaller. This is effective for reducing the size and lowering the weight of the compressor as a whole. Further, the configuration becomes streamlined. Therefore, this contributes greatly to the reduction of the manufacturing costs.

FIG. 41 shows a second example of the capacity control valve 130. This capacitor control valve 130 can also be used incorporated into the compressor of the 17th embodiment shown in FIG. 39. The second example of the capacity control valve 130 differs from the above first example in the point of the structure of the center electrode 144 supported through the insulated collar 145 inside the cylindrical part 134*a* provided at the rear end of the valve housing 134. In the second example, the center electrode 144 forms a hollow closed-bottom cylinder. The bottom surface supports one end of a compression spring 144*b*. The other end elastically supports a small disk-shaped power receiving plate 144*c*. The front end of an electrode rod 151*a* at the terminal 150 side abuts against the power receiving plate 155*c* and causes the compression spring 144*b* to flex somewhat. Therefore, even if there is some positional offset between the capacity control valve 130 and the terminal 150, power is supplied to the solenoid coil 135 without hindrance. The rest of the effects are similar to those of the first example explained above.

Figure 42:
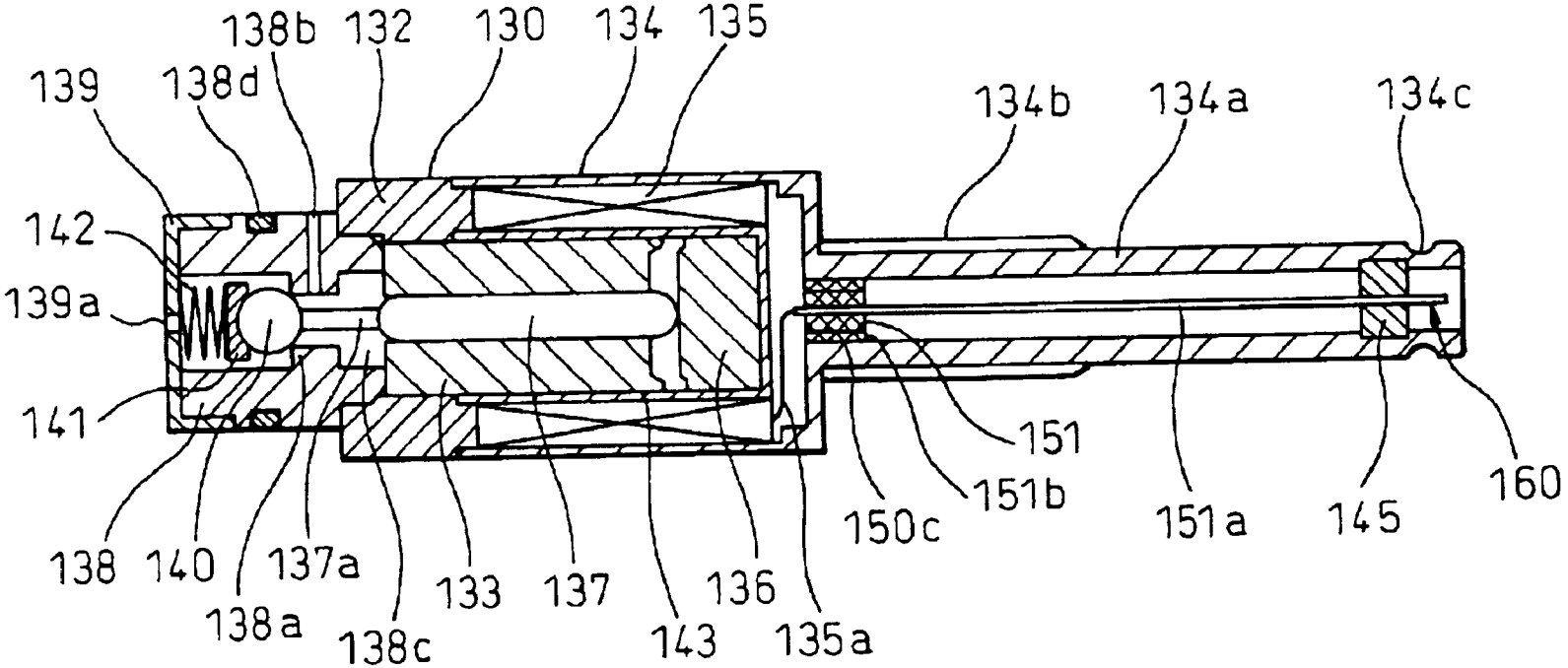
FIG. 42 is a longitudinal sectional view of a third embodiment of a capacity control valve and its related parts.

FIG. 42 shows a third example of a capacity control valve 130. The third example of the capacity control valve 130 differs from the above examples in the point that the terminal 150 provided separated from the control valve 130 in the first example and second example is formed integrally with the capacity control valve 130 in the third example. That is, the main body of the capacity control valve 130 has a similar structure as the first example, but the rear ends of the cylindrical part 134*a* connected to the rear end of the capacity control valve 130 and the electrode rod 151*a* extend sticking out slightly to the rear from the rear housing 3 and an insulating collar 145 is provided close to these rear ends to maintain the positional relationship and insulated state between the two. In this case, the front end of the electrode rod 151*a* becomes the power receiving part 160. A connector of a not shown outside conductor is connected to the same. The front end of the cylindrical part 134*a* is formed with a depression 134*c* for engagement with a lock of a not shown connector. According to the third example of the terminal 150, not only is it possible to simplify the structure of the portion corresponding to the terminal 150, but also similar effects are obtained as with the above first example etc.

Figure 43:
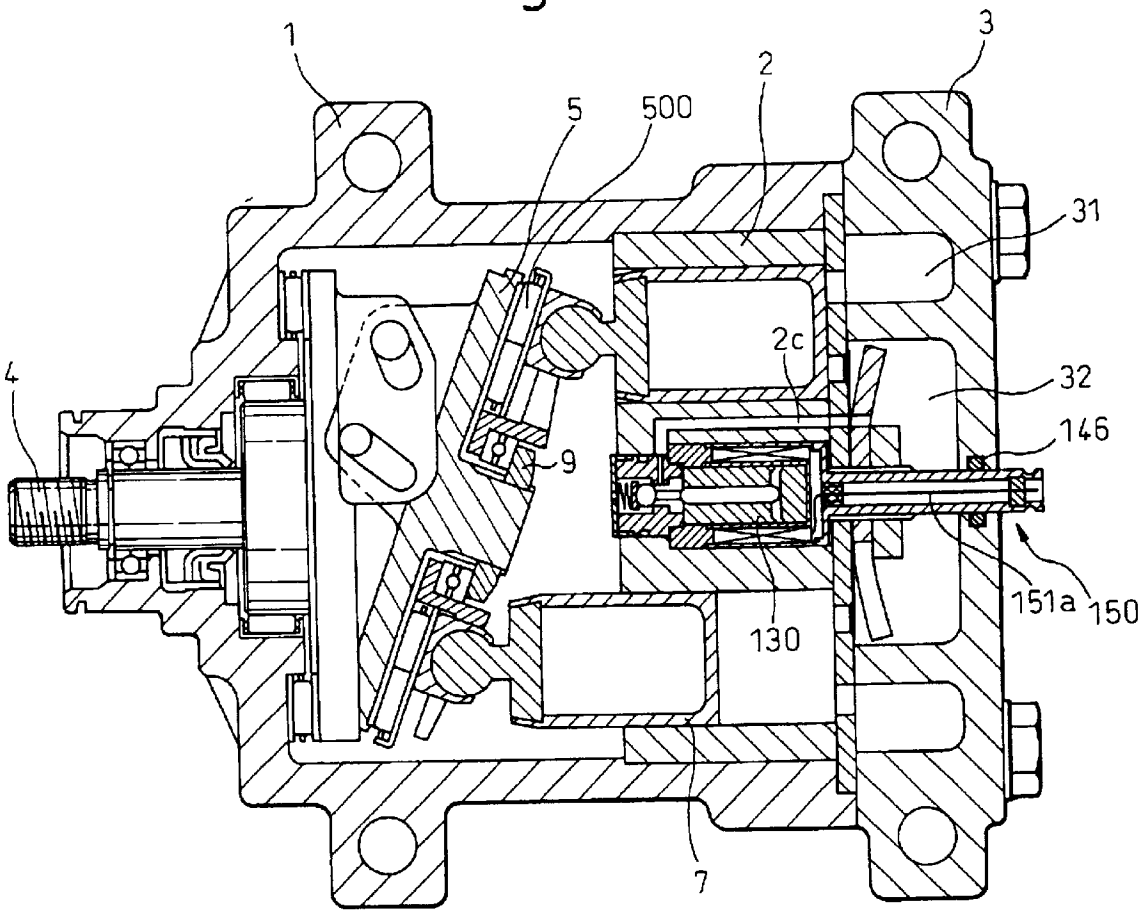
FIG. 43 is a longitudinal sectional view of a second embodiment of the compressor of the present invention.

The state of the capacity control valve 130 of the third example attached to a compressor is illustrated in FIG. 43 as an 18th embodiment of the compressor of the present invention. The point of difference from the compressor of the 17th embodiment shown in FIG. 39 is just that the portion corresponding to the terminal 150 in the first example of the capacity control valve 130 is replaced by the third example of the capacity control valve 130 shown in FIG. 42, so aside from the effects obtained by the capacity control valve 130 of the third example, actions and effects similar to the compressor of the 17th embodiment are exhibited. Note that an O-ring 146 is provided for simple sealing at the location where the cylindrical part 134*a* of the capacity control valve 150 extending long from the housing 134 passes through the rear housing 3.

Further, the 17th embodiment and 18th embodiment related to variable capacity type compressors, but the present invention is not characterized in the point of making the discharge capacity variable, so clearly the key parts of these embodiments can also be applied to fixed capacity type compressors. Further, the present invention is not limited to just drive plate type compressors.

While the invention has been described with reference to specific embodiments chosen for purpose of illustration, it should be apparent that numerous modifications could be made thereto by those skilled in the art without departing from the basic concept and scope of the invention.

What is claimed is:

1. A compressor comprising:

a shaft axially supported by only a front end part of a housing through a bearing and receiving rotational power from a power source;

a drive plate rotating by being connected with and supported by said shaft and able to tilt with respect to said shaft;

a shoe holding plate supported by said drive plate through a holding plate thrust bearing forming a roller bearing and thereby taking the same tilt angle, but prevented from rotating;

a plurality of shoes able to engage with a plurality of shoe guide grooves formed in a radial direction at a peripheral part of said shoe holding plate and slide in the radial direction;

a drive thrust bearing arranged between said shoes and said drive plate;

a plurality of pistons directly connected with said shoes and engaging in reciprocating motion, inserted in cylinder bores to suck in and compress a fluid, and preventing rotation of said shoe holding plate; and means for changing the tilt angle of said drive plate and said shoe holding plate to change a discharge capacity.

2. A compressor as set forth in claim 1, wherein each shoe is comprised of a shoe body provided with a spherical depression engaging with a spherical end provided at a corresponding piston and a shoe flange sticking out to the side integrally from said shoe body.

3. A compressor as set forth in claim 1, wherein each piston is comprised of a conical shoulder part formed integrally with a spherical end in advance, a cylindrical part joined with said conical shoulder part, and a bottom part joined with said cylindrical part.

4. A compressor as set forth in claim 1, wherein each piston is comprised of a conical shoulder part formed integrally with a spherical end in advance, a cylindrical part formed integrally with said conical shoulder part in advance, and a bottom part joined with said cylindrical part.

5. A compressor as set forth in claim 1, wherein each piston is comprised of a conical shoulder part formed integrally with a spherical end in advance, a cylindrical part joined with said conical shoulder part, and a bottom part formed integrally with said cylindrical part in advance.

6. A compressor as set forth in claim 1, wherein each piston is comprised of a conical shoulder part joined with a spherical end, a cylindrical part joined with said conical shoulder part, and a bottom part joined with said cylindrical part.

7. A compressor as set forth in claim 1, wherein each piston is comprised of a conical shoulder part joined with a spherical end, a cylindrical part formed integrally with said conical shoulder part in advance, and a bottom part formed integrally with said cylindrical part in advance.

8. A compressor as set forth in claim 1, wherein parts of each piston are joined by welding or calking.

9. A compressor as set forth in claim 1, wherein each piston is hollow.

10. A compressor as set forth in claim 1, wherein each piston is fabricated from a ferrous material.

11. A compressor as set forth in claim 1, further comprising a torsion coil spring biasing said drive plate in a direction reducing the tilt angle in a state where the tilt angle of at least said drive plate is large and in a direction increasing the tilt angle in an operating state where the tilt angle is zero or minimal.

12. A compressor as set forth in claim 11, wherein said torsion coil spring is a single, continuous spring.

13. A compressor as set forth in claim 1, wherein each shoe is comprised of a shoe body and a shoe flange, and said shoe body is formed by casting so as to surround a spherical end at said piston side.

14. A compressor as set forth in claim 1, wherein each piston is formed by casting so as to surround a spherical end of a connecting rod side where said piston is connected with a corresponding shoe.

15. A compressor as set forth in claim 1, wherein said drive thrust bearing is provided with a large number of short rollers arranged radially divided into groups on a plurality of concentric circles.

16. A compressor as set forth in claim 15, wherein a large number of short rollers arranged radially divided into groups on a plurality of concentric circles are held by a separate holder for each group of rollers on each concentric circle.

17. A compressor as set forth in claim 15, wherein a large number of short rollers arranged radially divided into groups on a plurality of concentric circles are held by a common holder.

18. A compressor as set forth in claim 17, wherein a plurality of rollers arranged in a radial direction on the same line among a large number of short rollers arranged radially divided into groups on a plurality of concentric circles are held by a same window opening formed in a common holder.

19. A compressor as set forth in claim 1, wherein each shoe pushed by said shoe holding plate is provided with a shoe flange integral with a shoe body, and a planar shape of said shoe flange is a substantially rectangular shape.

20. A compressor as set forth in claim 1, wherein each shoe pushed by said shoe holding plate is provided with a shoe flange integral with a shoe body, and a planar shape of said shoe flange is a substantially fan shape.

21. A compressor as set forth in claim 1, wherein each shoe pushed by said shoe holding plate is provided with a shoe flange integral with a shoe body, and a planar shape of said shoe flange is substantially a shape intermediate between a rectangular shape and fan shape.

22. A compressor as set forth in claim 1, wherein said drive thrust bearing is eliminated to allow said shoe to directly engage slidably with said drive plate.

* * * * *